US006138740A

United States Patent [19]

Chou

[11] Patent Number: 6,138,740

[45] **Date of Patent: *Oct. 31, 2000**

[54] BEARING STRUCTURE FOR VERTICAL BLINDS AND ROLLER SHADES

[76] Inventor: Tser-Wen Chou, 19464 Via Del Caballo, Yorba Linda, Calif. 92686

[ * ] Notice: This patent is subject to a terminal disclaimer.

[21] Appl. No.: 09/227,989

[22] Filed: Jan. 8, 1999

Related U.S. Application Data

[63] Continuation-in-part of application No. 09/200,578, Nov. 27, 1998, abandoned, which is a continuation-in-part of application No. 09/131,090, Aug. 7, 1998, Pat. No. 5,983,972, which is a continuation-in-part of application No. 08/917,584, Aug. 23, 1997, Pat. No. 5,875,829.

[51] Int. Cl.[7] ..... A47G 5/02

[52] U.S. Cl. ..... 160/319; 160/298

[58] Field of Search ..... 160/319, 298, 160/321, 307, 176.1 V, 177 V

[56] References Cited

U.S. PATENT DOCUMENTS

| | | | |
|---|---|---|---|
| 4,223,714 | 9/1980 | Weinreich et al. | 160/319 X |
| 4,291,593 | 9/1981 | Santambrogio | 160/319 X |
| 4,834,164 | 5/1989 | Tuhey | 160/319 |
| 5,137,073 | 8/1992 | Huang | 160/319 X |
| 5,488,983 | 2/1996 | Jung | 160/319 X |
| 5,875,829 | 3/1999 | Chou | 160/319 |
| 5,983,972 | 11/1999 | Chou | 160/319 |

*Primary Examiner*—David M. Purol
*Attorney, Agent, or Firm*—Curtis L. Harrington

[57] ABSTRACT

An improved bearing mechanism with both a relative larger axial force adjustment mechanism and a relatively smaller axial force adjustment mechanism, works in conjunction with the control rod of a vertical blind system or a roller shade system to provide superior bearing and load handling capability. A primary adjustment mechanism provides a first magnitude range of urging force of a bearing structure toward a housing as by the use of an axial bolt or the like. Inasmuch as this is difficult to adjust without removal of the roller shade and such adjustment is difficult gauge physically, a secondary adjustment structure enables tension adjustment over a second magnitude range of urging force and which is accessible without having to remove the roller. The secondary adjustment structure is a wedge which operates adjacent the main tension member.

20 Claims, 24 Drawing Sheets

485
487
489
501
501
491
481
479
497
499
499
493
495
499

535
539
539
537
545
479

485
497
499
499
541
499
495
493
499

485
495
499
533
533
499
531
497
499
493

453
485
479
469
515
515
515
481
475
517
511
401
399
373
373
401
399

BEARING STRUCTURE FOR VERTICAL BLINDS AND ROLLER SHADES

This application is a continuation-in-part of 09/200,578 filed Nov. 27, 1998, now abandoned, which is a Continuation-in-Part of U.S. patent application Ser. No. 09/131,090 filed Aug. 7, 1998, now U.S. Pat. Ser. No. 5,983,972 which was a Continuation-in-Part of U.S. patent application Ser. No. 08/917,584 filed Aug. 23, 1997, now U.S. Pat. Ser. No. 5,875,829.

FIELD OF THE INVENTION

The present invention relates to the field of window coverings and more particularly for improvements in bearing structures for adequately supporting and enabling the rotational movement of load bearing structures used to actuate vertical blinds and roller shades and which may be used to actuate any horizontal or other rotatable member.

BACKGROUND OF THE INVENTION

Conventional support and track systems for vertical blinds and roller shades have concentrated on two problems with two different structures.

First, for vertical blinds, the main objective has been to eliminate friction in actuating the rotation of the control rod which extends along the drapery track and which turns the individual vertical blind units simultaneously to admit or shut off light from entering the room. The control rod engages a gear associated with each support structure for each vertical blind panel, known as a carrier. The carrier has the ability to freely translate and roll within a raceway within the track, the system then having an ability to rotate the control rod to change the angle of the vertical blind panels regardless of where the carriers are located along the track.

Thus, the rod's contact with several carriers adds significant mechanical resistance to turning, especially when the turning is accomplished from the end of the vertical blind track. A significant turning force complicates the actuation with a pull chain, as the pull chain sprocket will normally experience additional friction from being actuated by being pulled downward, at a right angle from its axis of rotation.

One method and technique which has been applied to this problem is the use of the concentric reducing gear. This normally cuts the pull chain force in half by doubling the length of travel of the pull chain, but because of the lateral force friction, probably reduces the force by about ⅓. This can make the operation of the vertical blind set fussy and time consuming. Moreover, the gear mechanism significantly increases the cost of the mechanism, both from a number of parts standpoint, assembly standpoint, and even more importantly from a tolerance standpoint.

The cost for injection molded parts increases significantly once the tolerance specifications are made more exacting. Where several parts have to fit together and work properly, the tolerances have to be controlled within strict limits. Stricter limits translate to longer cycle times in the injection mold process and greater waste, both of which drive up the cost.

The size factor multiplies and exacerbates the above factors. Keeping tolerance on a small part is difficult. Having a series of smaller parts perform a load bearing function doesn't leave much room for wear. The use of a metal ball bearing set is out of the question as the added cost would be unbearable by the market.

Roller shades present the problem of controlled friction, coupled with bearing lateral force resistance and wear. One popular design uses a two ended coil spring which is activated by pushing the spring in an unwind direction to cause it to lose its grip and move. The spring, however, produces a good deal of friction upon the cylindrical tube upon which it is mounted. So, where the spring is made strong enough to strongly resist pulling on the window shade, it adds significant friction to the tube upon which it is mounted. Since the ends of the springs are all that hold the window shade in place, making a smaller spring would cause the force from the shade to bend the spring ends. As a result, the window covering industry has had to settle for a device which produces significant resistance to operation in order to provide window roller shade control. In reality, the force moment on a roller shade is small due to a general balance of material when rolled up, and a relatively short turning moment when fully unrolled.

In both the window shade and vertical blind configurations, the necessity to place greater force on the actuating member, particularly in the downward direction, means that greater time and effort must be expended in making certain that the mounting of the track or bracket is sufficient to withstand the pulling force of the actuation member, usually a looping suspended chain. So even in instances where dry wall would be sufficient to hold the roller shade or vertical blinds and more, additional labor and structure will be needed to further anchor the window covering device to a stud or beam. Of course, all installations should be secure, but where additional anchoring is needed simply because of the unreasonable forces needed to operate the window covering mechanism, the added money for much higher installation costs are not justified.

What is therefore needed is a mechanism for a window covering device which can be inexpensively injection molded and which makes up for relaxed tolerance in manufacture. The device should have load bearing capability and for roller shades, the resistive force to prevent the unwinding of the window shade should be adjustable.

SUMMARY OF THE INVENTION

An improved bearing mechanism works in conjunction with the control rod of a vertical blind system or a roller shade system to provide superior bearing and load handling capability. A conical bore has a plurality of grooves into the surface of the conical bore. A series of cylindrical rollers may be supported within the grooves, and against a central rotational member having a conical surface for bearing against the rollers. A set screw is used to control the seating of the central rotational member within the conical bore, is used to make up any tolerance created through the manufacturing process, and can be used to increase the tension necessary to hold a roller shade in place. A roller shade system with a sprocket having opposite conical bearing surfaces may involve two sets of conical bearings, which may be frusto-conical in shape, and which may preferably uses two bearing systems in each roller blind installation provides a more stable, more secure, and more evenly balanced roller shade assembly. An improved ball chain sprocket uses widely spaced barriers and interstitial deep troughs to insure a good fit with a ball chain pull rope.

BRIEF DESCRIPTION OF THE DRAWINGS

The invention, its configuration, construction, and operation will be best further described in the following detailed description, taken in conjunction with the accompanying drawings in which.

DETAILED DESCRIPTION OF THE PREFERRED EMBODIMENT

Figure 1:
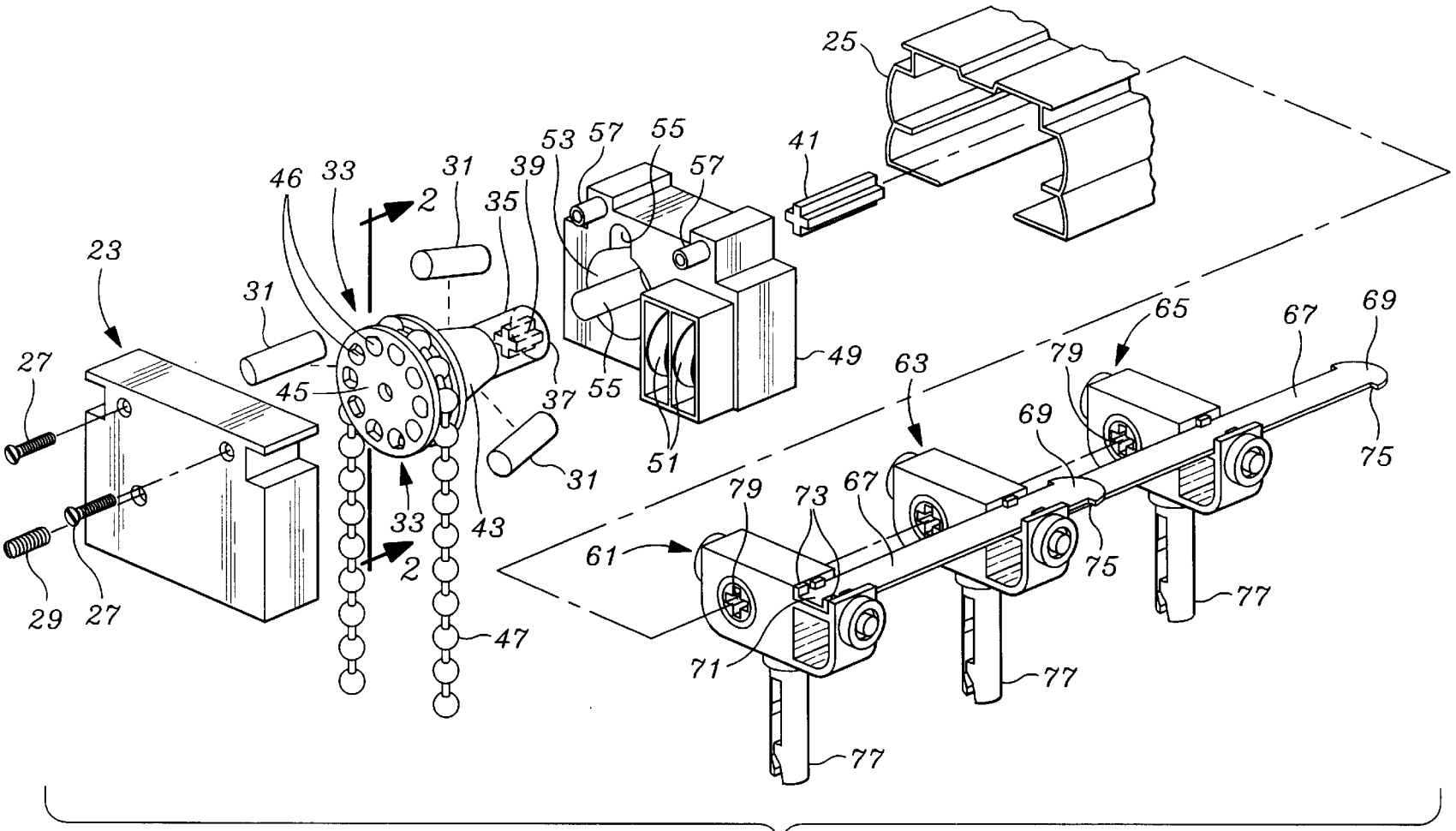
FIG. 1 is a perspective partially exploded view of the system used with a vertical blind configuration and in which the end unit is open illustrating the main rotational member.

The description and operation of the invention will be best initiated with reference to a vertical blind configuration which shown in FIG. 1. FIG. 1 is perspective partially exploded, distributed view illustrating a vertical blind system 21 made up of structures which are shown outside of their supporting rail or track which provides vertical support and enables horizontal translation of the vertical blind panels (also not shown) which are typically drawn to cover a window or sliding door. Beginning at the left, an outer housing member 23 has an outer shape which matches the outer shape of track 25. A series of two upper screws 27 are used for attachment of the outer housing member 23, while a set screw 29 is threadably supported by the outer housing member 23 and is used for adjustment by being urged into the outer housing member 23, as will be shown.

To the right of the outer housing member 23, a series of three solid cylindrical roller bearings 31 are shown surrounding a central bearing member 33. Hollow cylindrical roller bearings 31 can be used, or in extreme cases no roller bearings 31 need be used. However, if no roller bearings are used, the tolerances between the components making up the system of 21 must be much closer and exacting than normal; but it is remembered that compensating for non-perfect manufacturing tolerances is one objective which the inventive configuration is meant to compensate. Each of the roller bearings 31 is preferably a solid cylindrical tube, although it is possible to use a series of spherical ball bearings if chosen based upon the correct size and number to fit within a holding space. A hollow cylindrical tube could provide for lighter weight, but one which is formed from sheet stock might not have a sufficient closure weld, and one formed from tubing might not be strong enough to hold. Any number of roller bearings 31 can be used.

The central bearing member 33 has a cylindrical portion 35 having an end 37 into which a key fit, or in this case, what is shown as a cross shaped cavity 39 is formed. The cross shaped cavity will interfit with and rotate a control bar 41, which enables the central bearing member to transmit rotational force to the control rod 41. Central bearing member 33 has a conical bearing surface 43 which directly impinges upon and rolls against the roller bearings 31. However, as will be seen, some amounts of the contact force with respect to the roller bearings 31 will occur along their end edges, and this in turn depends on the tolerance and size.

Opposite the end at which the cross shaped cavity 39 is located, the central bearing member 33 has a disc shaped chain sprocket portion 45, having a series of apertures 46. The apertures 46 accommodate the spheres of a chain or ball rope 47 and provide traction between the sprocket portion 45 and ball rope 47. The ball rope 47 shown passing over the sprocket portion 45 and which extends downward. The apertures 46 are optional and appear where the sprocket portion 45 is thin and such structures enable the ball rope 47 to gain traction. Typically the ball rope 47 will form a closed loop at the bottom of its lower extent so that the chain may be continuously operated to turn the central bearing member 33.

To the right of the central bearing member 33 is an inner housing 49. Inner housing 49 carries a pair of rope pulleys 51 in the event that the carriers used in the vertical blind are to be displaced by pull ropes. Another alternative is the use of a wand mounted to a pull carrier. Adjacent the rope pulleys 51 is a central frusto-conical bore 53, which is complementary to the conical bearing surface 43. Evenly spaced within the central frusto-conical bore is a series of rounded slots 55. The slots 55 are rounded such that width is wider than the roller bearings 31, but the depth is sufficiently shallow that the roller bearings always have contact with the conical bearing surface portion 43. As will be seen, the slots 55 are formed with a larger radius circle r2 such that the radial center point is displaced slightly more toward the entrance of the slot 55. Put another way, circle r2 is more shallowly formed into the surface of the central frusto-conical bore 53, than the diameter r1 of the roller bearing 31 to cause the roller bearing 31 to protrude into the central frusto conical bore to contact the conical bearing surface 43. At the top of the inner housing 49 is a pair of engagement bosses 57 which provide the material into which the screws 27 are engaged to hold the outer housing member 23 onto the inner housing 49. The inner housing 49 is so named since its exterior shape is made to fit within the end of the track 25.

The control bar 41 is oriented to fit through a series of carriers 61, 63 & 65. A lead carrier, and its connection to ropes which would be supported by the pulleys 51 are omitted for clarity. Each of the carriers 61, 63 & 65 are designed to spread apart to a defined spacing when the vertical blind system 21 is closed and the window or door covered, and to compress to a close spacing when the vertical blind system 21 is opened and the window or door is exposed. The carriers 61, 63 & 65 have a series of slidably displaceable spacer tabs 67 each having a head end portion 69 with a horizontally enlarged portion and a tail end portion 71 with a vertically extending portion 73, to enable carriers 61, 63 & 65 to become automatically spaced and collapsed, but with no interference of the spacer tabs 67. The head end portions 69 can fit through an upper "U" shaped space 75 in each succeeding one of the carriers 61, 63 & 65 enabling the head end portions 69 to "stack" within the "U" shaped space 75. Each of the carriers 61, 63 & 65 has a vertically downwardly extending vane support 77.

The control rod 41 extends through a series of worm gear sleeves 79 within each of the carriers 61, 63 & 65 to rotate the series of vertically downwardly extending vane supports 77 to cause vertical blind panels (not shown) to rotate between a closed, light blocking position and a light admitting open position. When the system 21 is assembled, actuation of the ball rope 47 will cause the control rod 41 to actuate the vertically downwardly extending vane supports 77.

Figure 2:
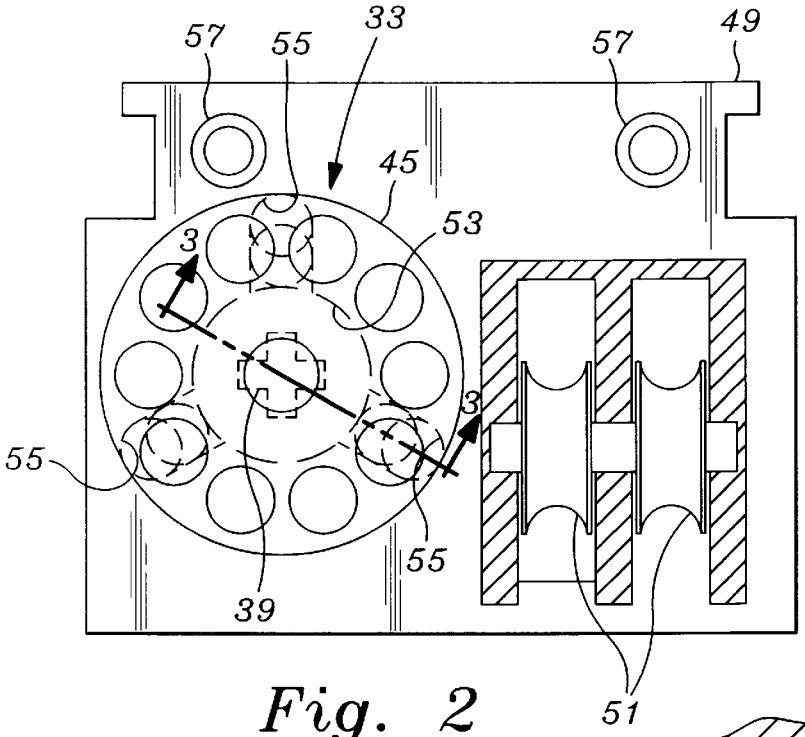
FIG. 2 is an end view of the housing shown in FIG. 1 and showing the angled nature of the bearings, which are shown in phantom, as well as cord pulleys for operating the carriers across a track.

Referring to FIG. 2, a view taken along line 2—2 of the assembled housing, including the outer housing member 23 and the inner housing member 49 illustrates the end of the chan sprocket portion 45 of the central bearing member 33. The central frusto-conical bore 53 and its series of rounded slots 55 are shown in what appears to be double phantom, but it must be remembered that the series of rounded slots 55 are angled with respect to the straight-on view of FIG. 2 and thus have a nearer, circumferentially greater located end and a farther away, circumferentially smaller located other end, with respect to the center of the central bearing member 33.

The rope pulleys 51 are shown in greater detail and may be press-fit within the inner housing 49. The end view of the bosses 57 show their thickness to accommodate the screws 27, and which may also be formed to interfit with the outer housing member 23.

Figure 3:
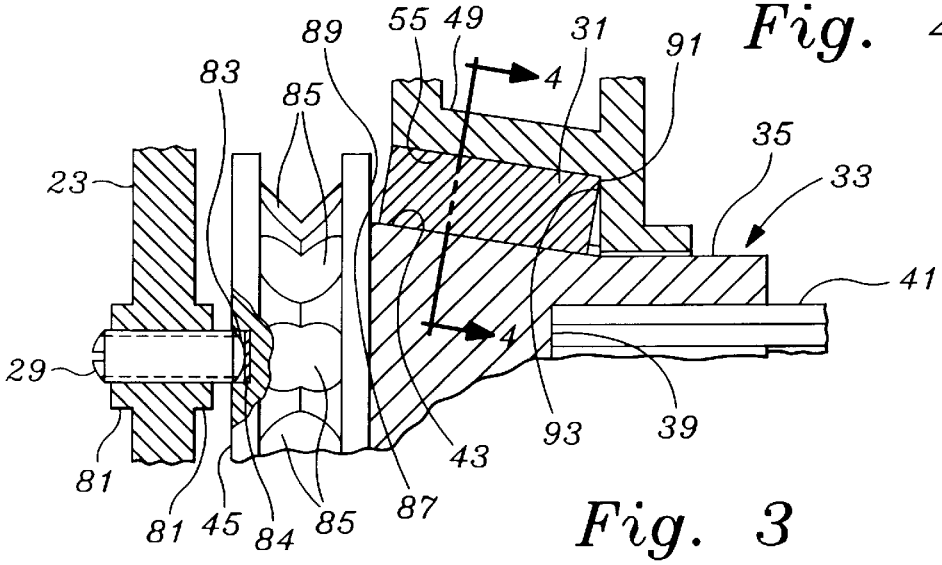
FIG. 3 is a sectional view taken along line 3—3 of FIG. 2 and illustrate the end edge contact of the roller bearings on the face end of the central bearing member and on the opposite edge of the roller bearing at the end of a groove in the cylindrical bore of the bearing housing.

Referring to FIG. 3, a section taken along line 3—3 if FIG. 2 and which also illustrates portions of the outer housing member 23 are shown, since it is shown in assembled form. In this view, set screw 29 is shown within a pair of bosses 81 formed in outer housing member 23. As an alternative, an optional sleeve could be used having a metal internal thread for reinforced support by the outer housing member 23 and to prevent stripping of the set screw 29 with respect to the outer housing 23. As can be seen, the inside tip of the set screw 29 contacts the disc shaped chain sprocket portion 45 at a shallow bore 83, and which contains a thin metal plate 84 to prevent a wearing away of the center of the disc shaped chain sprocket portion 45. With the shallow bore 83, the set screw can act both to urge the central bearing member 33 forward, and also impart some centering assistance. Downward lateral force on the central bearing member 33 will be resisted both by the central bearing member 33 being surrounded by the inner housing 49, and by support from the set screw 29 engagement with the shallow bore 83.

Also seen are a series of round depressions 85 in the disc shaped chain sprocket portion 45. Each of the depressions 85 accommodates one sphere shaped member of the ball rope 47. At the upper side of FIG. 3, the roller bearing 31 can be seen as a hollow cylinder. Here can be seen two important areas of engagement of the roller bearing 31. The end of the roller bearing 31 facing the disc shaped chain sprocket portion 45 has a circumferentially innermost (measured with respect to the axis of the central bearing member 33) edge 87 which may roll against a radial surface 89. A gap is shown between the edge 87 and the radial surface 89, as would be expected to be present, particularly if the tolerances in the materials were not as exact.

At the other end of the roller bearing 31, an edge 91 rolls against an inner corner surface 93 of the series of rounded slots 55. Where the clearance adjacent the edge 87 exists, the roller bearing 31 may axially displace itself within the slot 55 as it rotates.

In this configuration, the roller bearing 31 has a dual mode of turning. First, the roller bearing 31 turns between the rounded slot 55 of the inner housing 49 and the conical bearing surface 43 of the central bearing member 33. Second, the circumferentially innermost edge 87 of the end of the roller bearing 31 closest to the disc shaped chain sprocket portion 45 rolls against the radial surface 89, as the circumferentially outermost edge 91 of the other end of the roller bearing 31 farthest from the disc shaped chain sprocket portion 45 rolls against the corner surface 93 of the end of the rounded slot 55. The angle of the roller bearings 31 with respect to the axis of the central bearing member 33 may vary between 5 and 15 degrees, and preferably is at 10 degrees.

Figure 4:
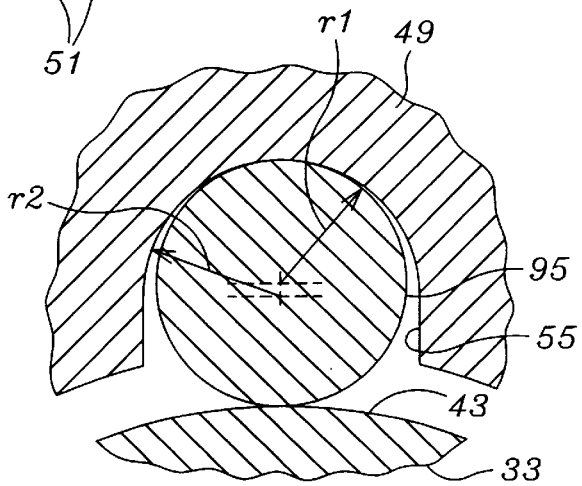
FIG. 4 is a section taken along line 4—4 of FIG. 3 and which illustrates the confines of the roller bearing grooves and the bearing contact with the conical surface of the main bearing, and also illustrates a hollow cylindrical version of the roller bearing.

Referring to FIG. 4, a view taken along line 4—4 of FIG. 3 illustrates the overall shape of the rounded slot 55. The dimensions of the slot are important, and some of the preferred dimensions follow. The roller bearing is preferably about 0.382 inches long. The outer radius is about 5/32 (five-thirty seconds) of an inch in diameter.

The rounded slot has two radius measurements, which are essentially two superimposed radii. The radius r1 is 5/64 of an inch and is taken from the center of a cylindrical roller bearing 95 to the middle surface of the slot 55. A second circle having a radius r2 of about 11/128 of an inch the taken from a radial point displaced slightly out of the slot 55, to create a 0.017 inch gap between the inner housing 49 and central bearing member 33, and which may approximate the differences in the radial centers for the two radii.

The widest point of the central frusto-conical bore 53 is preferably about 0.45 inches in radius, while the narrowest point is about 0.225 inches in radius. The conical tilt is about 10° from the axis of the central bearing member 33. Other angles of tilt are permissible, but it is remembered that a greater angle of tilt will require more pressure from the set screw 29 to hold the central bearing member 33 in place.

Figure 5:
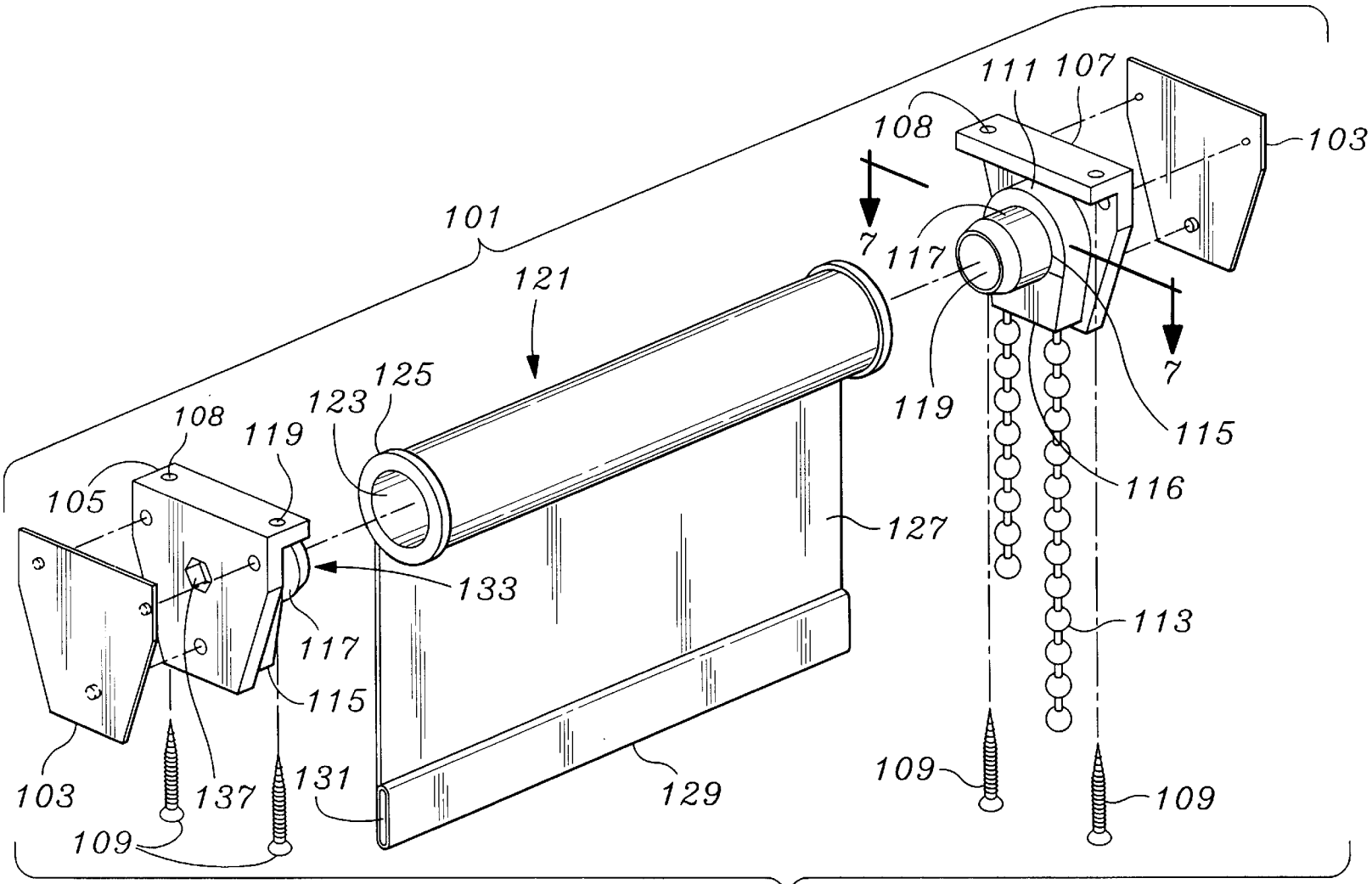
FIG. 5 is an exploded view of a roller shade configuration utilizing the roller bearings of the invention in a different configuration.

Referring to FIG. 5, a roller shade system 101 is illustrated. The roller shade system 101 utilizes many of the same principles as set forth for the vertical blind system 21, but utilizes a different structure. Beginning at the left, a cover plate 103 covers the end of a first bracket 105. The bracket 105 is angled and has the capability to be mounted against the mounting with screws or nails through both the bracket 105 and walls. At the other side of the drawing a bracket 107 is also seen. Brackets 105 and 107 have apertures 108 at its shallow end to accommodate a set of screws 109 for mounting on a wall in the other direction. Either or both of these mounting methods may be used.

Referring to the upper portion of the Figure for clarity, a roller shade control unit 111 is either attached to or formed integrally with a second bracket 107. The control unit 111 has a ball rope 113 which may be of the metal ball and link type, or may be of a rope and ball type. The control unit 111 has a plate shaped housing portion 115, including a cover plate portion 116, and a cylindrical insertion member 117 extending therefrom. The cylindrical insertion member 117 has a beveled tip portion 119 to facilitate its insertion into a roller shade tube assembly 121. The roller shade tube assembly 121 is in the shape of a hollow tube 123 and, in this case has a radially extending land 125 which can be helpful to help the shade material 127 roll onto the hollow tube 123 without binding or interfering with the ends. At the bottom of the shade material, a hem, or doubling over of the material 129 carries a stick 131 of wood or plastic to provide some greater weight at the bottom.

At the end of the roller shade tube assembly 121, a turning support 133 is located. A pure turning support 133 will have a matching plate shaped housing portion 115, and a cylindrical insertion member 117, and will merely provide rotational support for the other end of the roller shade tube assembly 121. However, with the present system, a second roller shade control unit 111 can be mounted on the first bracket 105 while the second bracket has an identical roller shade control unit 111, and will be shown in FIG. 6.

Since the roller shade control units 111 operate based upon friction, a window shade system 101 with two control units 111 can split the force necessary to operate the roller shade tube assembly 121. The use of two control units 111 are especially helpful where the window shade system 101 is used with an especially long roller shade tube assembly 121 and the user can operate it from either end. This is not possible with the two ended spring system discussed in the background section, since the two ended spring, which already has a heavy friction burden on actuation, has a lock out from any turning operation conducted from an opposite end of its roller shade tube assembly, such dual end operation is not possible.

Figure 6:
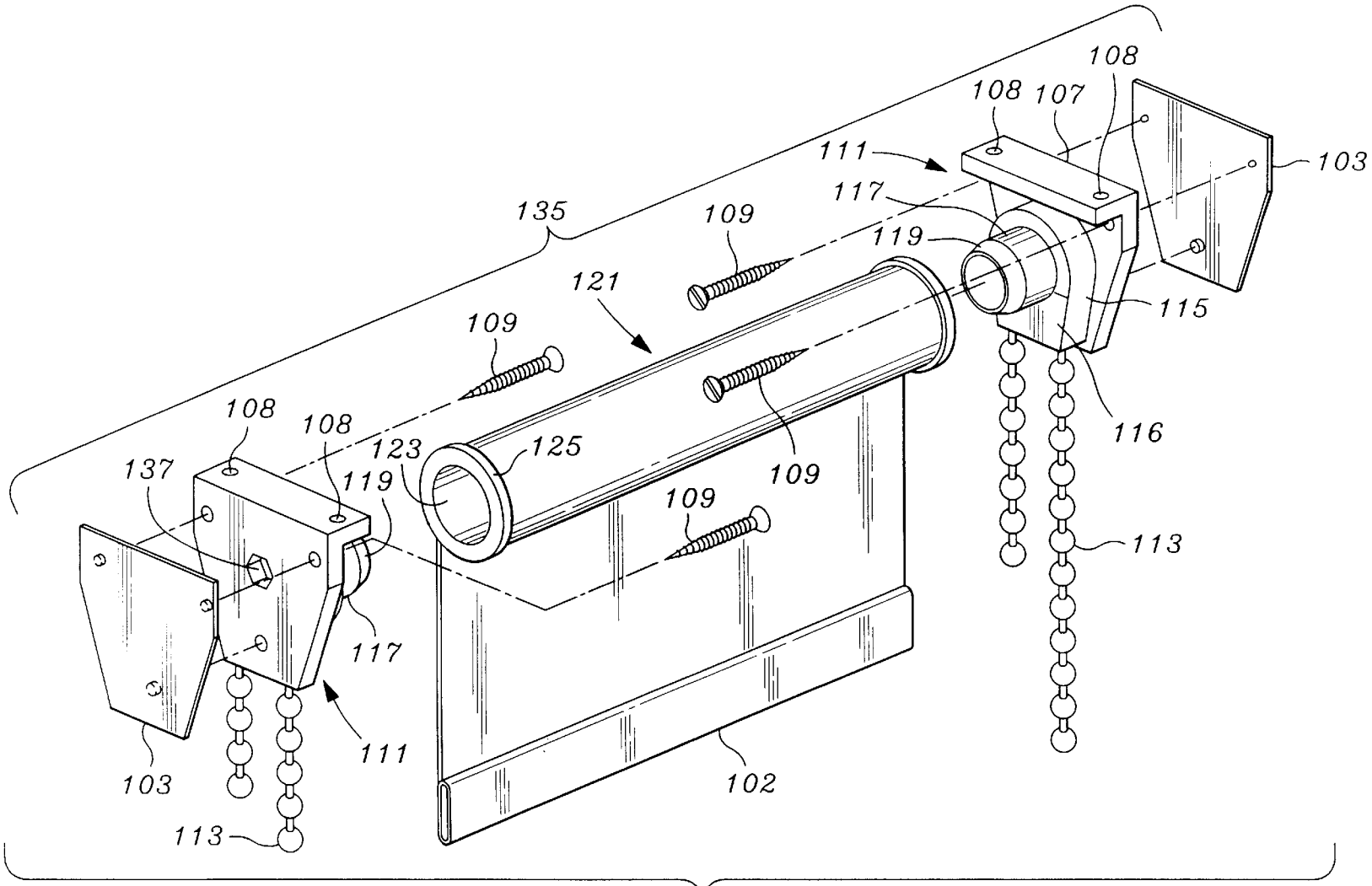
FIG. 6 is a configuration of the roller shade as shown in FIG. 5, but with two actuation and friction units, one at each end of the roller shade.

Referring to FIG. 6, a system 135 illustrates two brackets 107. Note a hexagonal recess 137 at the back of the bracket 107, which will be for accommodating and rotationally locking a bolt head, which is shown in FIG. 7.

Figure 7:
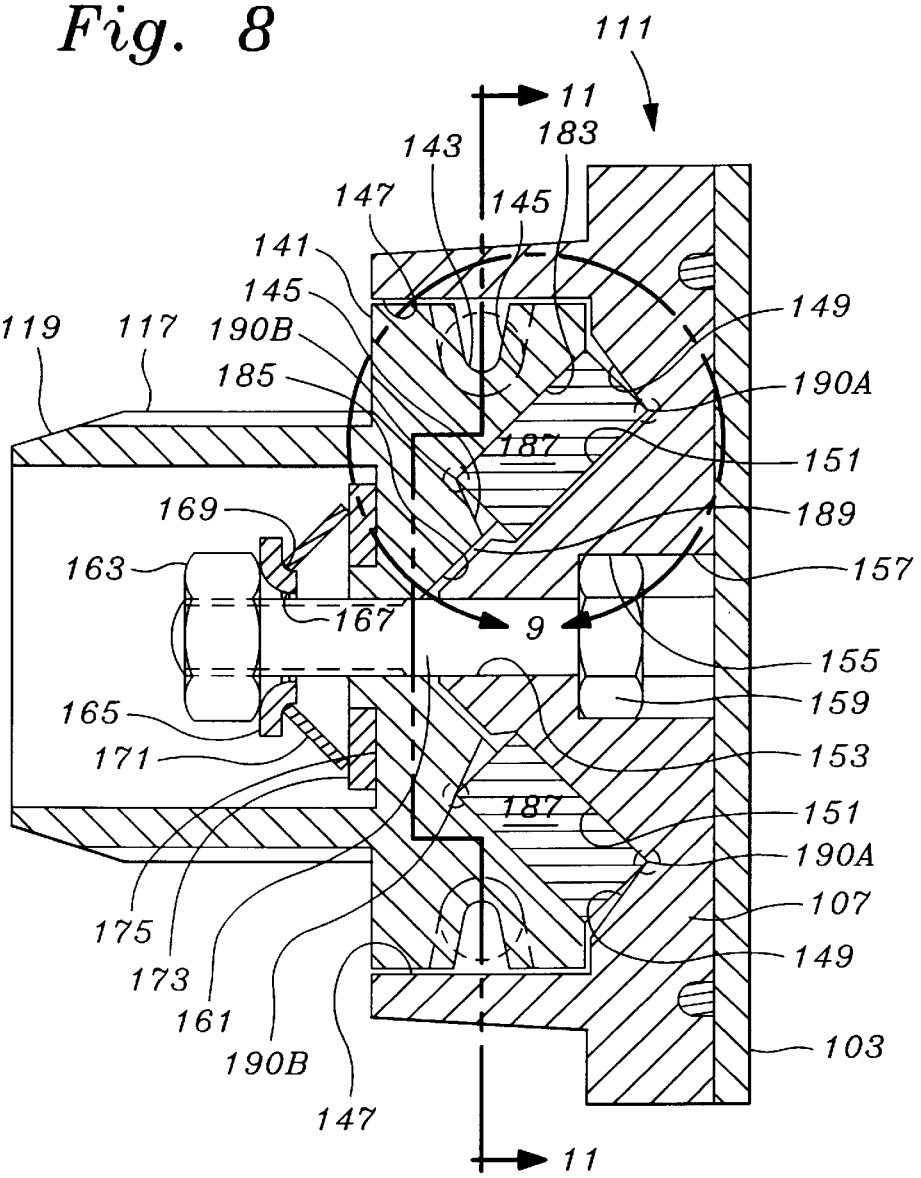
FIG. 7 is a sectional view taken along line 6—6 of FIG. 5 and illustrating the internal bearing areas.

Referring to FIG. 7, a section taken along line 7—7 of FIG. 5 illustrates the internals of a roller shade control unit 111 which is integral with the second bracket 107. As can be seen, the cylindrical insertion member 117 continues inside the control unit 111 and is integral with a sprocket portion 141. Sprocket portion 141 carries a slot 143 having a series of accommodation spaces 145 to interfit wit the balls of the ball rope 113 to enable the ball rope 113 to have positive traction with respect to the sprocket portion 141.

As can be seen, the outer curved portion of the control unit 111 is formed integrally with the second bracket 107. The internal features thereof include a circular outer bore 147, an angled roller bearing accommodation slot 149, a central conical bearing surface 151, and a central bore 153. At the side of the second bracket 106 facing the cover plate 103 is the hexagonal shaped bore recess 137 which extends throughout the length of such bore. The hexagonal shaped bore 137 is a straight bore, but it may have a hexagonal radial surface closest to the bore 153 and some other larger smooth or rounded surface leading back to the cover plate 103. Hexagonal shaped bore 137 can be of any shape which will captures a hexagonal head 159 of a bolt 161.

The other end of bolt 161 engages a nut 163 which engages threads on the bolt 161. Note that there is more than adequate clearance within the cylindrical insertion member 117 to reach the nut 164 with a socket wrench or a hex driver. The nut 163 and bolt 161 are used to compress the cylindrical insertion member 117 and its sprocket portion 145 against the second bracket 107.

The compression members which apply force from the nut 163 to the cylindrical insertion member 117 are carefully chosen. Nut 163 bears against a punched bore washer 165, which has the inner most portions of its material, nearest its aperture 167 through which the bolt 161 extends, turned downward to make an external groove 169 into which a smooth conical surface of a lock washer 171 interfits. The lock washer 171 is a toothed lock washer having an outer diameter of about 16 millimeters and an internal diameter of about 8.4 millimeters.

The teeth of the toothed lock washer 171 bear against an oversized flat washer 173, which in turn bears against a flat radial surface 175 of the inside of the cylindrical insertion member 117. In this configuration the turning of the cylindrical insertion member 117 is isolated from the ability to turn the nut 163. In order for the nut 163 to turn, the turning of the cylindrical insertion member 117 must transmit its turning force to the flat washer 173, and from the flat washer 173 to the lock washer 171 through its widely dispersed and low surface contact area teeth, and from the lock washer 171 through its conical upper neck to the smooth external groove 168 of the punched bore washer 165, and then from the punched bore washer 165 to it tangential contact about the lower rim of the nut 163 which is preferably a lock nut, having some polymeric engagement with the bolt 161 to further prevent its unintended movement. At each bearing junction just mentioned, much slippage is expected to occur. It is expected that the chain of slippage will be such that the turning force applied to the nut 163, when and if it occurs, will not be sufficient to move the nut 163.

The internal features of the cylindrical insertion member 117 include a brief conical spacing surface 181 which rides over and should ideally have no contact with the central conical bearing surface 151. Adjacent the conical spacing surface 181 is a slot 183 which has an upper angled end surface 185 to provide clearance for the roller bearing 187, which may be identical to or sized differently from the roller bearings 31 seen in FIGS. 1–4. The internal dimensions of the slot 183 will be the same as those previously discussed for FIG. 4, in that the roller bearing 31 is given a wider space for lateral movement, than the spacing it is given for its depth. Again, the size of the roller bearing 31 is such that it will always protrude from its slot 183 to extend across a gap 189 between the conical bearing surface 151 and the conical spacing surface 181, to engage the conical bearing surface 151 and be primarily structurally responsible for keeping the gap 189 during the turning process. Note that the accommodation slot 149 is angled away from the roller bearing 31 such that the inner edge of the roller bearing 31 contacts the apex of an angle formed between the accommodation slot and the central conical bearing surface 151 at a corner 190A. Likewise, at the other end of the roller bearing 31, the upper angled end surface 185 and the slot 183 form an angle, the apex of this angle is contacted by the outer edge of the roller bearing 31, at a corner 190B. Any number of roller bearings 187 can be used.

The roller bearings 187 are angled with respect to the axis of the bolt 161 and may vary between 35 degrees and 55 degrees with respect to the axis of the bolt 161 and is preferably at 45 degrees.

Figure 8:
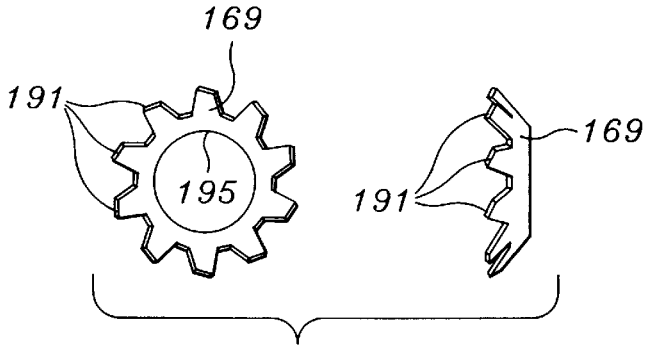
FIG. 8 is an expanded plan and side view of the lock washer seen in FIG. 7.

Referring to FIG. 8, an expanded plan and side view of the lock washer 169 is shown, including its teeth 191 and central aperture 195.

Figure 9:
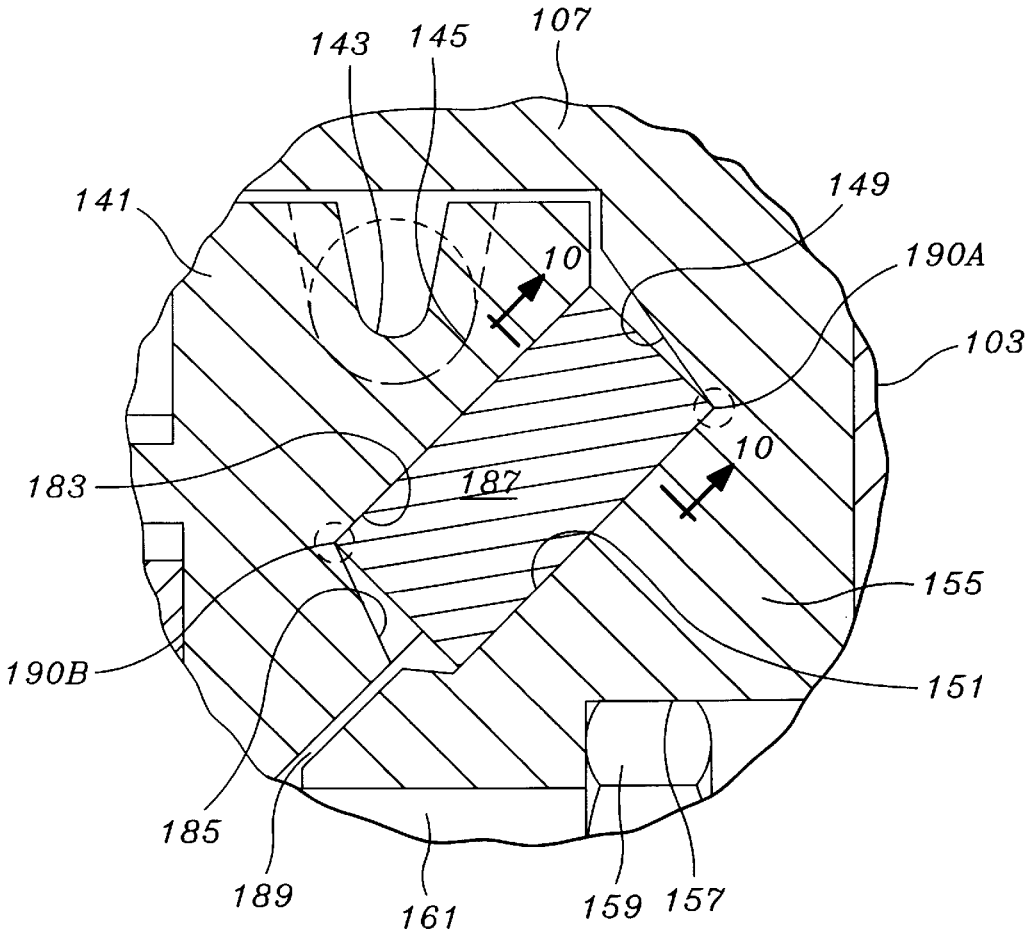
FIG. 9 is a closeup plan view looking into the space surrounding the roller bearing with an identification of its terminal radius, and side radius and blending from one to the other.

Referring to FIG. 9, a closeup view of the structures immediately surrounding the roller bearing 187 are illustrated. For clarity and understanding. As the sprocket portion 141 and cylindrical insertion member 117 turn together, the roller bearing 187 turns within its slot 183 as it rolls against the central conical bearing surface 151. The force of turning of the sprocket portion 141 and cylindrical insertion member 117 with respect to the bracket 106 will depend upon the axial tension exerted by the nut 163 and bolt 161. This tension can be pre-set when the bracket 106 is assembled. For custom installations, the tension can be re-set during installation to exactly match the needed tension for adequately supporting the roller shade tube assembly 121, typically in a position when the roller shade tube assembly has its shade material 127 maximally extended or near the expected maximal extension to be encountered for a given window or door. Also seen are the corners 190A and 190B which bear force from the rolling edges of the roller bearings 187.

Figure 10:
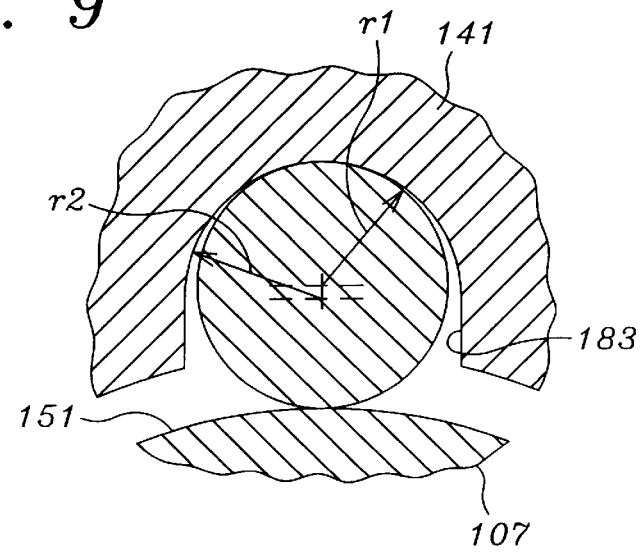
FIG. 10 is a closeup view, taken along line 10—10 and illustrating the details of the roller bearing and adjacent structures.

The roller bearings 187, slots 183 and conical bearing surface 151 are all parallel and inclined preferably about 45° from the axis of the bolt 161. The roller bearing 187 is preferably about 10.14 millimeters long and has an exterior diameter of about 4.0 millimeters. The slot 147 is again formed of two superimposed radii having different center points of sweep. FIG. 10 shows a radius r1 having a radius of about 2.0 millimeters. A radius r2 has its center point displaced slightly toward the central conical bearing surface 151, and has a radius r2 of about 2.25 millimeters. Again, the radius r1 and the radius r2 each have a sweep which is superimposed over each other and define the resulting shape of the slot 183.

Figure 11:
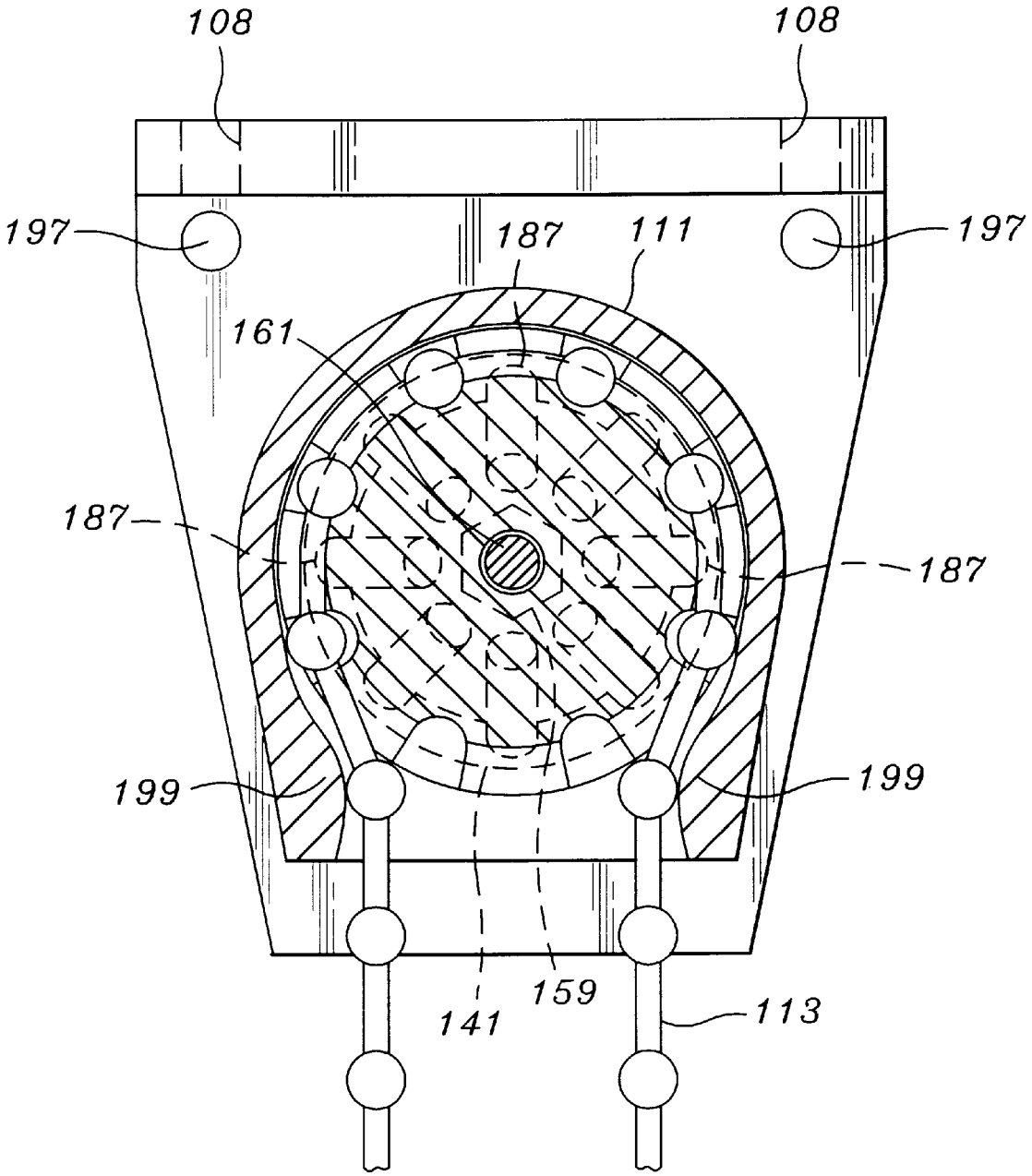
FIG. 11 is a sectional view taken along line 11—11 of FIG. 7, and illustrating the placement of the roller bearings at angular positions in between the balls of the chain for better distribution of force.

Referring to FIG. 11, an end view taken along line 9—9 of FIG. 7 illustrates the use of eight roller bearings 187. It is clear that 3, 4, 5, 6, 7, and 8 roller bearings can be used and the number will depend upon the degree of balance and smoothness desired. The orientation of FIG. 11 is such that the roller bearings 187 are positioned between the points of support for the spheres of the balls of a ball rope 113. Also shown is the bolt 161 hexagonal head 159, and in detail the series of accommodation spaces 145 which accommodate each of the balls of the chain 113. A pair of side mounting apertures or bores 197 are seen, in addition to the apertures 108. A pair of curved guides 199 can be used to urge the bottom portion of the ball rope 114 together to give greater traction and to help prevent slippage of the ball rope 113 in the slot 143.

Figure 12:
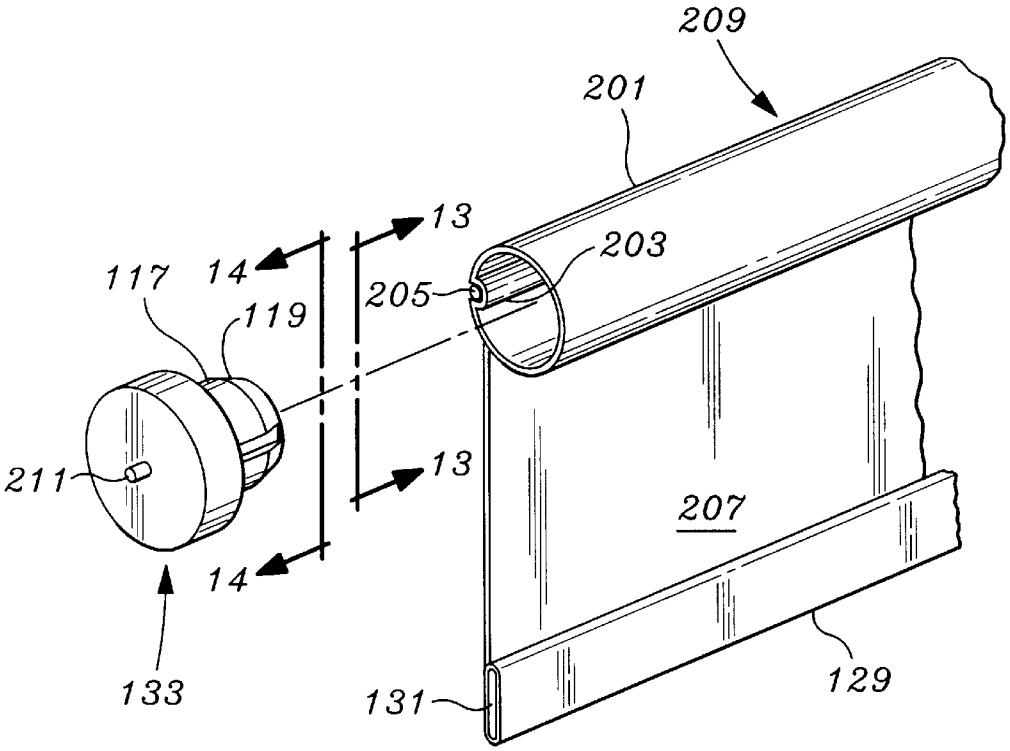
FIG. 12 is a closeup, exploded view of the non frictional fitting, and illustrating how it fits inside a window shade roller tube having an internal indent, or key, as well as the use of the indent as a key to hold the roller shade material.

Referring to FIG. 12, a metal tube 201 is used as an alternative to traditional roller shade tubes. The tube 201 has a slot 203 extending along the side of the tube. The slot 203 supports an elongate rod 205. The elongate rod holds a length of thin roller shade material 207 inside the slot 203. In the alternative, a series of shortened rods 205 can be used to hold the material 207 inside the slot 203 at various intervals along the tube 201. The material 207 forms a roller shade 209 and has many of the same structures as shown for roller shade 121. The turning support 133 is seen to have a short length axle 211 about which it is rotatably supported by the bracket 105 seen in FIG. 5.

Figure 13:
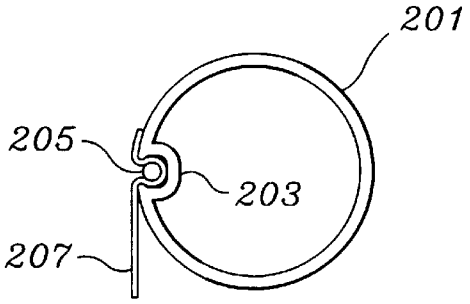
FIG. 13 is an end view, taken along line 11—11 and illustrating how the roller shade material fits within the slot and that it is held in by a pin or other structure within the slot.
Figure 14:
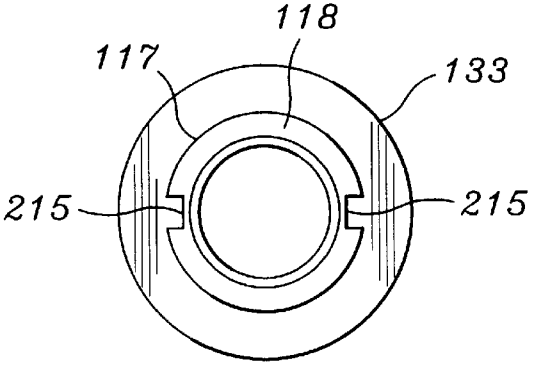
FIG. 14 illustrates an end view taken along line 14—14 of FIG. 12.

Referring to FIG. 13, an end view shows with greater detail the holding of the material 207 within the slot 203, and the position of the rod 205. Referring to FIG. 14, the turning support 133 can be seen to have a pair of side slots 215 which accommodate the internal extend of the slot 203 and not only permit cylindrical insertion member 117 to be inserted into the end of the tube 201, but rotationally lock the tube 201 with respect to the turning support 133. This feature is not as important for the free rotating end of the roller shade system 101 or 135, but this feature is used with the cylindrical insertion member 117 of control unit 111. One, two, three, four or more of the side slots 215 may be provided.

Figure 15:
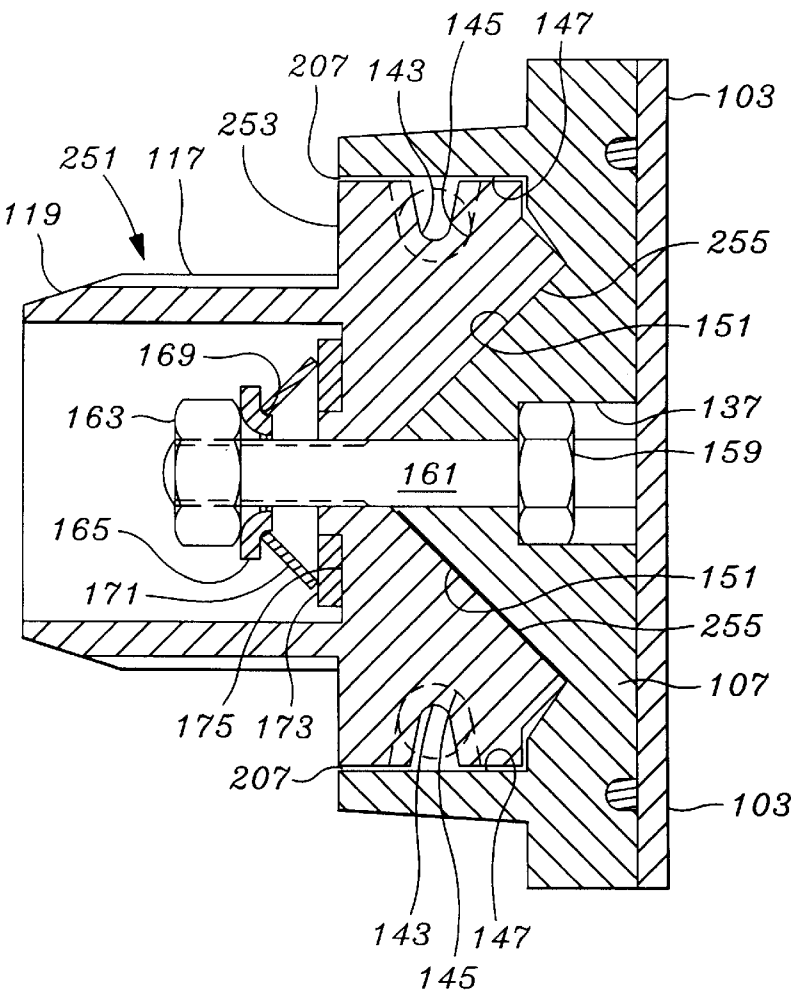
FIG. 15 illustrates a cross sectional view, similar to that seen in FIG. 7 where a pair of conical bearing surfaces carry no roller bearings.

As stated previously, the roller bearings 187 help control the friction in the control unit 111. Referring to FIG. 15, a control unit 251 is provided having the conical bearing surface as was seen in FIG. 7, but where a sprocket portion 253 carries an inwardly disposed conical surface 255 which is complementary to and opposes the central conical bearing surface 151. Note that a gap 257 may be provided in any configuration leading up to the mating faces of the surfaces 151 and 255. As such other surfaces may be formed to a lesser tolerance since a non-touching relationship is expected to occur, and may include circular outer bore 147. Except for the replacement of the slots 183, and the provision of the inwardly disposed conical surface 255, the structure and operation of the control unit 251 is the same as was the case for control unit 111.

Figure 16:
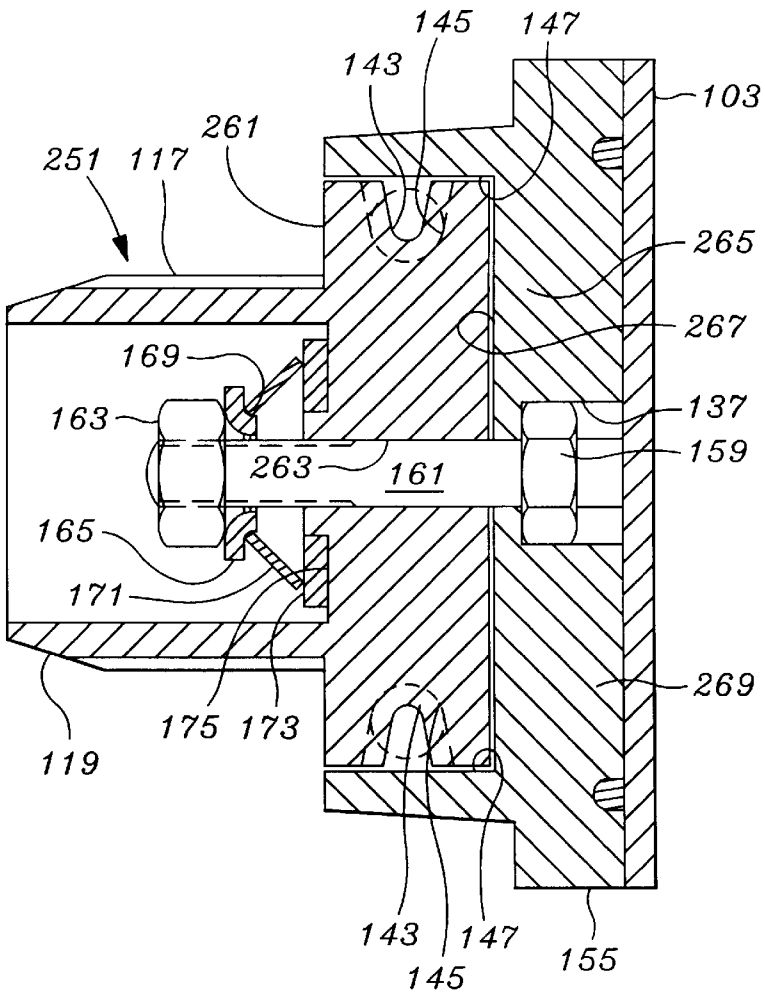
FIG. 16 illustrates a cross sectional view, similar to that seen in FIGS. 7 and 15 where a pair of cylindrical and radial bearing surfaces are used.

Referring to FIG. 16, a different embodiment, as a variation of the embodiment of FIG. 15 shows a bearing relationship of a sprocket portion 261 which uses a longer internal bore 263 with which to provide a longitudinal bearing surface against the bolt 161. Sprocket portion 261 has an expanded radial surface 265 which may operate against an expanded radial surface 267 located within the a differently shaped bracket 269. The operation of the control unit 251 is the same as was the case for control unit 111.

Figure 17:
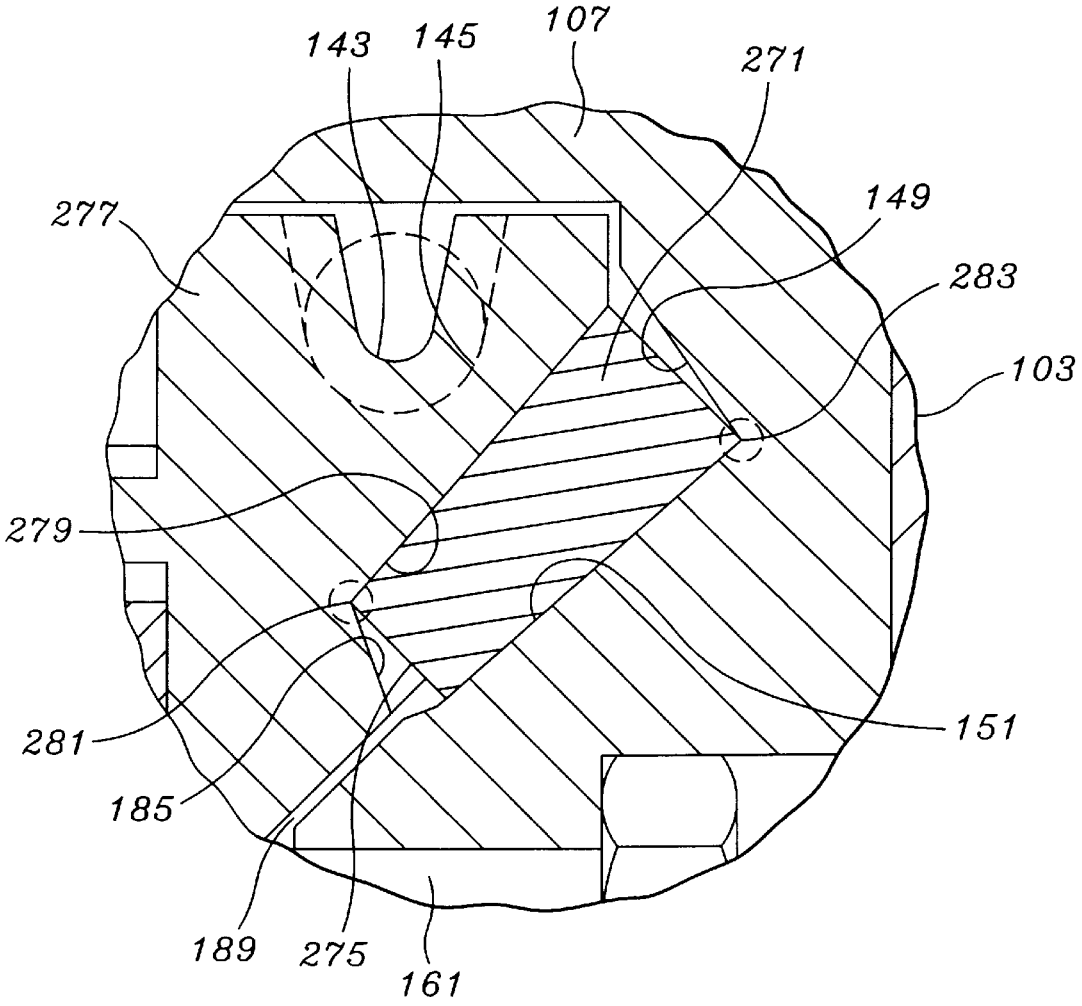
FIG. 17 illustrates a variation in the shape of roller bearings, shown with respect to the view of FIG. 9, as a frusto-conical shaped roller bearing, with the larger end of the bearing positioned to travel over a longer path than the smaller end.

Referring to FIG. 17, a view similar to that seen in FIG. 9 is shown. A frusto-conical bearing 271 is seen with a large end 273 and a small end 275. The large end 273 is circumferentially farther from the axis of turn of a sprocket portion 277 which has a slot 279 which is not completely parallel to the central conical bearing surface 151. The slot 279 defines an open curved area, but which also tapers to meet the tapering contact line on the frusto-conical bearing 271. Rolling contact edges 281 and 283 are present similar to the edges shown earlier.

In practice, in a household sized roller shade, the frusto-conical bearing 271 will be about 2.0 to 5.0 millimeters in diameter, with the frusto-conical bearing 271 being preferably about 3.0 millimeters in diameter. The typical length of conical bearing 271 will be from about 6 to about 13 millimeters long, with the frusto-conical bearing 271 shown being preferably about 10 millimeters long. For the 10 millimeters length, a desired taper would include a larger end 273 having a diameter of about 4.0 millimeters and a smaller end 275 having a diameter of about 3.0 millimeters. As such, the angle of taper as a deviation from a straight cylindrical bearing is from about two to about four degrees and preferably about three degrees. Although the corners 190A and 190B which are essentially edges, as well as the corners 281 and 283, but shown as corners in the sectional drawings are expected to bear a significant portion of the frictional contact. By using a frusto-conical bearing 271, the linear displacement coverage of one end of the frusto-conical bearing 271 more nearly matches the other end of the frusto-conical bearing 271. Differential slippage is not generally a problem, but increases the frictional contact and bearing which can be generated over a shorter range. The use of the frusto-conical bearing 271 enables the use of other forces to create friction and broadens the friction over a greater range of axial tension adjustments of bolt 161.

As the sprocket portion 277 and cylindrical insertion member 117 turn together, the frusto-conical bearing 271 turns within its slot 279 as it rolls against the central conical bearing surface 151. The slot 279 follows the shape of the frusto-conical bearing 271 to insure that constant clearance is obtained along the length of the frusto-conical bearing 271. The slot 279 is then also some what tapering in its profile.

Figure 18:
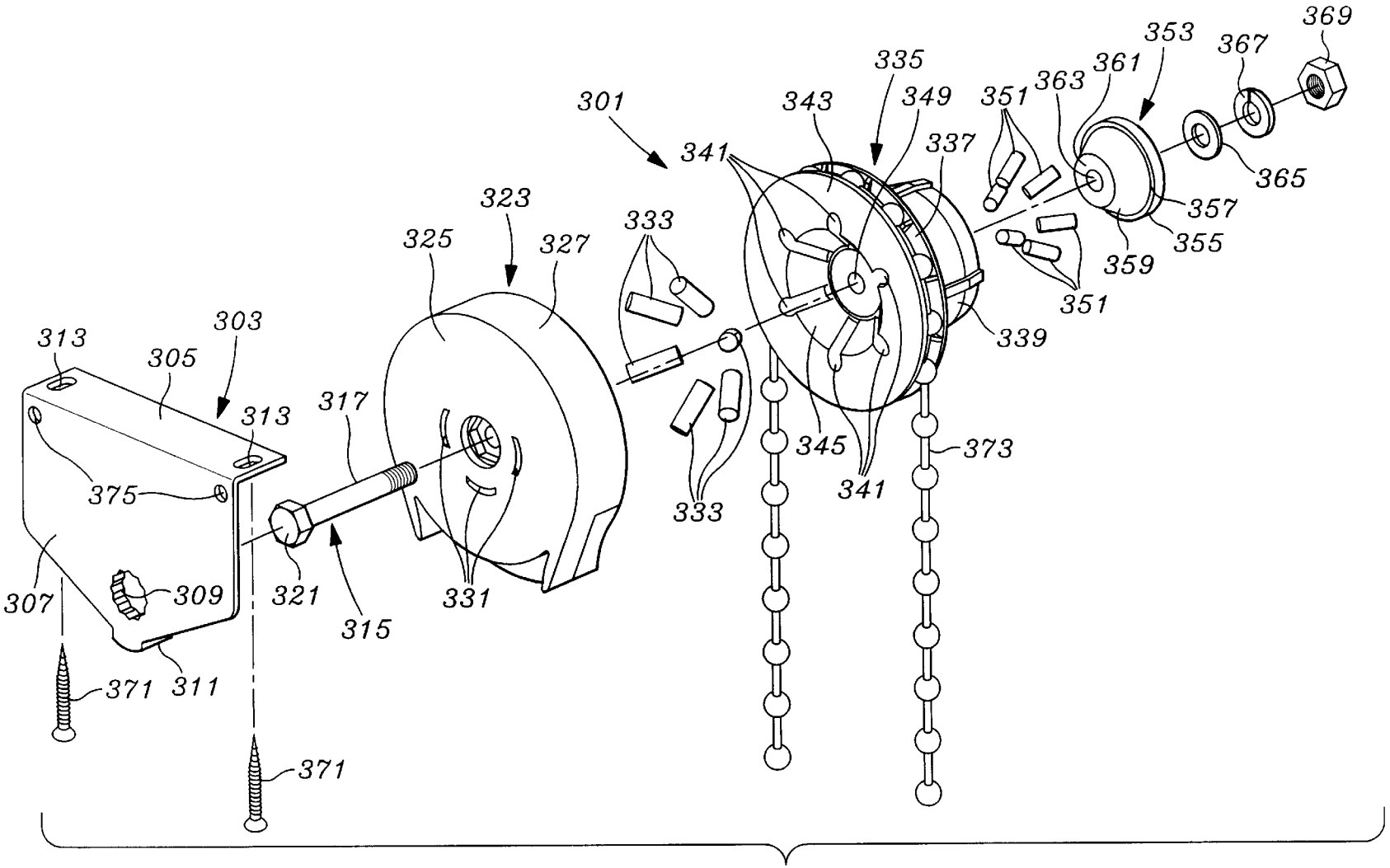
FIG. 18 illustrates an exploded view of a further embodiment of a roller shade mechanism which uses opposing sets of roller bearings to temper the frictional control to be hand in controlling a roller shade.

Referring to FIG. 18, an exploded view of a further embodiment of a roller shade mechanism which uses opposing sets of roller bearings to temper the frictional control to be hand in controlling a roller shade is shown. In the embodiments of FIGS. 17 and previous Figures, the sprocket portion 141 received bearing support from one side, the other side of sprocket portion 141 having a bearing arrangement which was ultimately frictionally connected with the bolt 161. In FIG. 18, an additional, opposing set of roller bearings are provided and which enable an additional structure to be both fixed with respect to its support bolt, and act as a bearing surface with respect to the second set of roller bearings.

FIG. 18 illustrates a roller shade system 301. At the left side of FIG. 18 is a mounting bracket 303 having an abbreviated width upper member 305 and a main planar expanse 307. The main expanse 307 includes a formed double hexagonal bore 309, and a lower cantilevered key 311. The bracket 303 has a pair of upper mounting apertures 313 in the upper member 305, and a pair of side mounting apertures 315 in the main planar expanse 307. Note that the formed double hexagonal bore 309 extends farther into the mounting bracket 303 than the indicated thickness of the mounting bracket 303 along its edge. The formation of the formed double hexagonal bore 309 is accomplished by using some of the material in the bore 309 to extend inward. This formation may be by closely controlled stamping and the like.

To the right of the bracket 303 is a bolt 315 having a shaft 317 threaded at the end and a bolt head 321 at the opposite end. The bolt head 321 is designed to interfit and be rotationally fixed once the bolt head 321 is fit inside the double hexagonal bore 309. To show the fit by analogy, bracket 303 could be used as a wrench, since the fit of the formed double hexagonal bore 309 is wrench-like with respect to the bolt head 321. Adjacent the threaded end of the bolt 315 is main housing 323. Housing 323 has a surface 325 facing the bracket 303 and a side and upper radial surface 327. Into the surface 325, a main bore 329 extends therethrough. Surrounding the main bore 329 and located 90° apart with respect to main bore 329 are a series of three curved slots 331, any one of which interfits easily with the lower cantilevered key 311 of the bracket 303.

Adjacent the main housing 323 are a series of six roller bearings 333 which may be straight cylindrical or frusto-conical, but which will be further explained as frusto-conical to facilitate the illustration of other details related to the frusto-conical shape. A bearing supported sprocket 335 includes a chain drive channel 337 adjacent a cylindrical insertion member 339. The roller bearings 333 interfit within slots 341. Since the roller bearings 333 are frusto-conical, with the larger ends located circumferentially outward, each of the slots 341 are similarly tapered such that their widths at the circumferentially outer positions are relatively wider than the slots 341 at their relatively circumferentially inner positions. Since the taper, as has been discussed, is only from about two to four degrees, and since the size is small, slots 341 do not appear overtly tapering, especially from the view of FIG. 18.

The side of the sprocket 335 adjacent the roller bearings 333 includes a outwardly located radially flat surface 343 which transitions into a general conical surface 345. The slots 341 interrupt the surfaces 345 and 343. The surface 345 at its concentric innermost extent, is bound by a radially flat surface 347, generally parallel to surface 343, and having a bore 349 at the center thereof.

To the right of the sprocket 335, a second set of six roller bearings 351 are illustrated. The roller bearings 351 fit within the inside of cylindrical insertion member 339, as will be shown. A conical bearing structure 353 is located to the right of the roller bearings 351. The conical bearing structure 353 includes a radial outwardly located land 355, a very brief radial surface 357 and then a transition to a conical bearing surface 359. The conical bearing surface 359 transitions at its concentrically innermost area into a radial surface 361 having a bore 363 at the radial center thereof.

To the right of the conical bearing structure 353 is a washer 365, preferably made of metal. To the right of the washer 365 is a lock washer 367 having a split, typically angled, and to the right of lock washer 367 is a lock nut 369 having a friction insert to resist turning on the threaded end of bolt 315. In operation, the sprocket 335 and sets of roller bearings 333 and 351 turn against the non moving bearing surfaces of the main housing 323 (not yet shown), and the conical bearing surface 359 of the conical bearing structure 353. Since the bolt 315 is rotationally locked with respect to the bracket 303 by the double hexagonal bore, and since the main housing 323 is locked with respect to the lower cantilevered key 311 inserted into the slots 331, the bolt 315 will not turn. The conical bearing structure 353 will normally resist movement since the roller bearings 351 are more likely to turn. However, in the unlikely event that the conical bearing structure 353 turns, it will have great difficulty turning the washer 365. If the washer 365 turns, it will have great difficulty turning the lock washer 367, and if the lock washer 367 turns there will be the greatest difficulty in turning lock nut 369.

In the configuration shown in FIG. 18, the roller bearings isolate turning to the bearing supported sprocket 335. It is recommended to have two of the complete roller shade support systems 301 for each window shade application, rather than a system 301 on one side and a dummy hinge on the other, in order to distribute the turning force and turning force resistance across the width of the roller shade being supported. Screws 371 are seen in position for attaching the mounting bracket 303, but any attachment configuration may be used. A ball chain 373 is seen engaged over the bearing supported sprocket 335. Additional mounting apertures 375 are seen, and bracket 303 may have other mounting apertures, but apertures 313 and 375 are placed so as to not interfere with the close interfitting of the housing 323 against the bracket 303.

Figure 19:
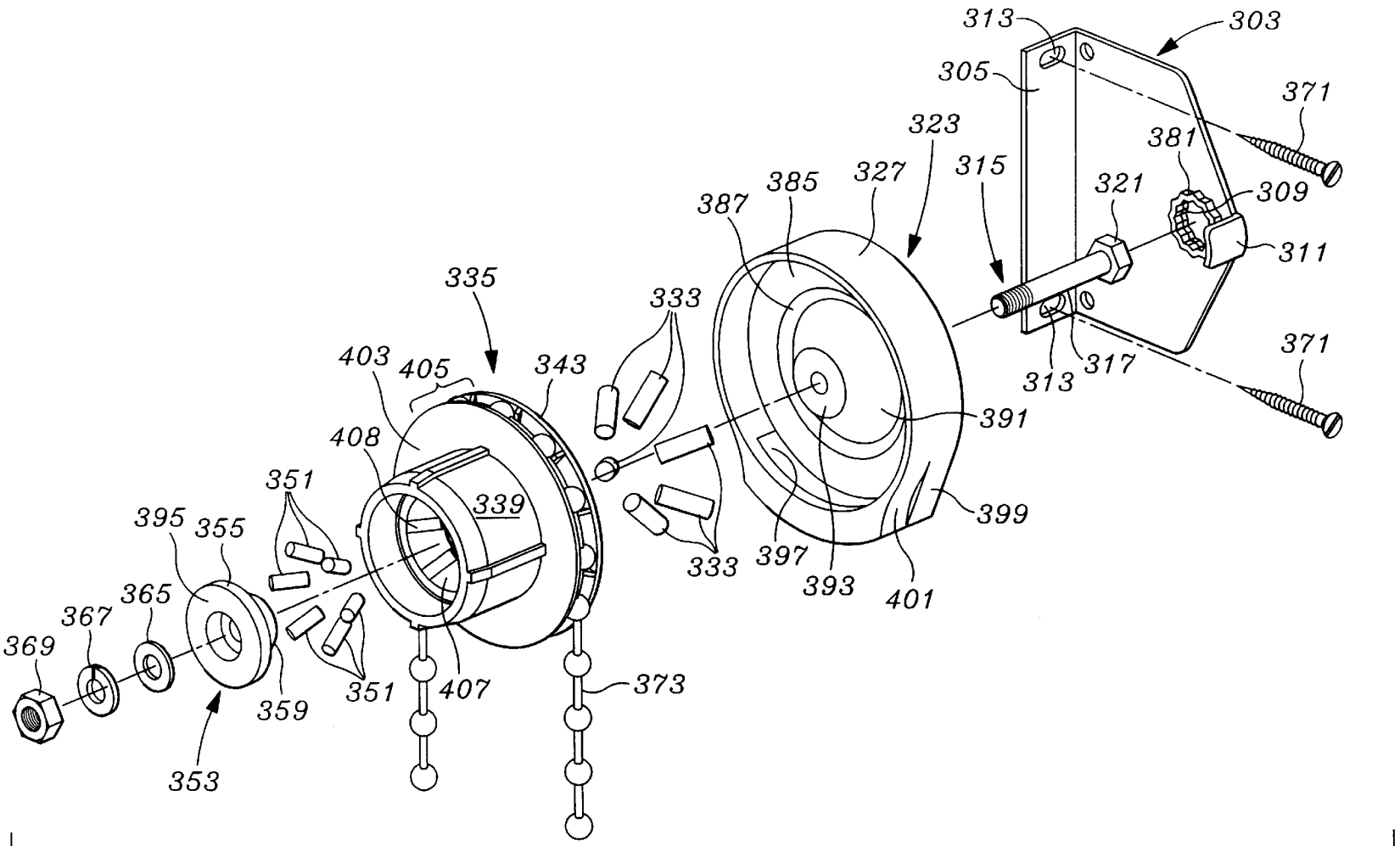
FIG. 19 is an exploded view from the opposite angle as seen in FIG. 18 and further illustrating details of the roller shade mechanism.

FIG. 19 is an exploded view from the opposite angle as seen in FIG. 18 and further illustrating details of the roller shade system 301. On the bracket 303, a raised annular boss portion 381 of the double hexagonal bore 309 is seen extending toward the main housing 323. The annular boss portion 381 fits slightly within the main bore 329 of the main housing 323. In this configuration, the double hexagonal bore 309 accommodates the bolt head 321 to a greater extent, since the bolt head may be three to four times deeper than the thickness of the bracket 303. Double hexagonal bore 309 then provides an additional surface area for engagement with the bolt head 321, without having to accommodate the bolt head outside of the outside of the planar expanse 307 of the bracket 303. Instead the material strength of the bracket 303 is made available to the bolt head 321 even as the bolt head 321 extends into the main bore 329 of the main housing 323.

As can be seen, the surfaces of the main housing 323 which face the roller bearings 333 include a main radial surface 385 transitioning concentrically inwardly to an angled surface 387, and then transitioning concentrically inwardly to a conical surface 391. Conical surface 391 is provided for the roller bearings 333 to rollably bear against. Conical surface 391 transitions concentrically inward to a small radial surface 393, the radial surface 393 having bore 329 at its center.

Conical bearing structure 353 is also seen has having a radial surface 395. In operation, the bracket 303 can be mounted to either one of an opposite pair of side surfaces or an overhead surface. In each of these mounting configurations, the main housing 323 can achieve a position such that a ball rope 373 can be extended into and out from a chain slot 397. The main housing 323 has a relatively straight inwardly angled portion 399 adjacent an inwardly curving portion 401 to help keep the ball chain 373 straight. Because of the way the structures on the sprocket 335 are set, the ball chain 373 can be easily threaded into the chain slot 397. Also seen is a radially flat surface 403, which together with radially located radially flat surface 343 defines a chain pulley 405 therebetween.

Also partially seen in FIG. 19 is a generally conic surface 407 having a second set of slots 408 for accommodating the roller bearings 351, and for engaging rolling action between the conical surface 359 and the generally conical surface 407.

Figure 20:
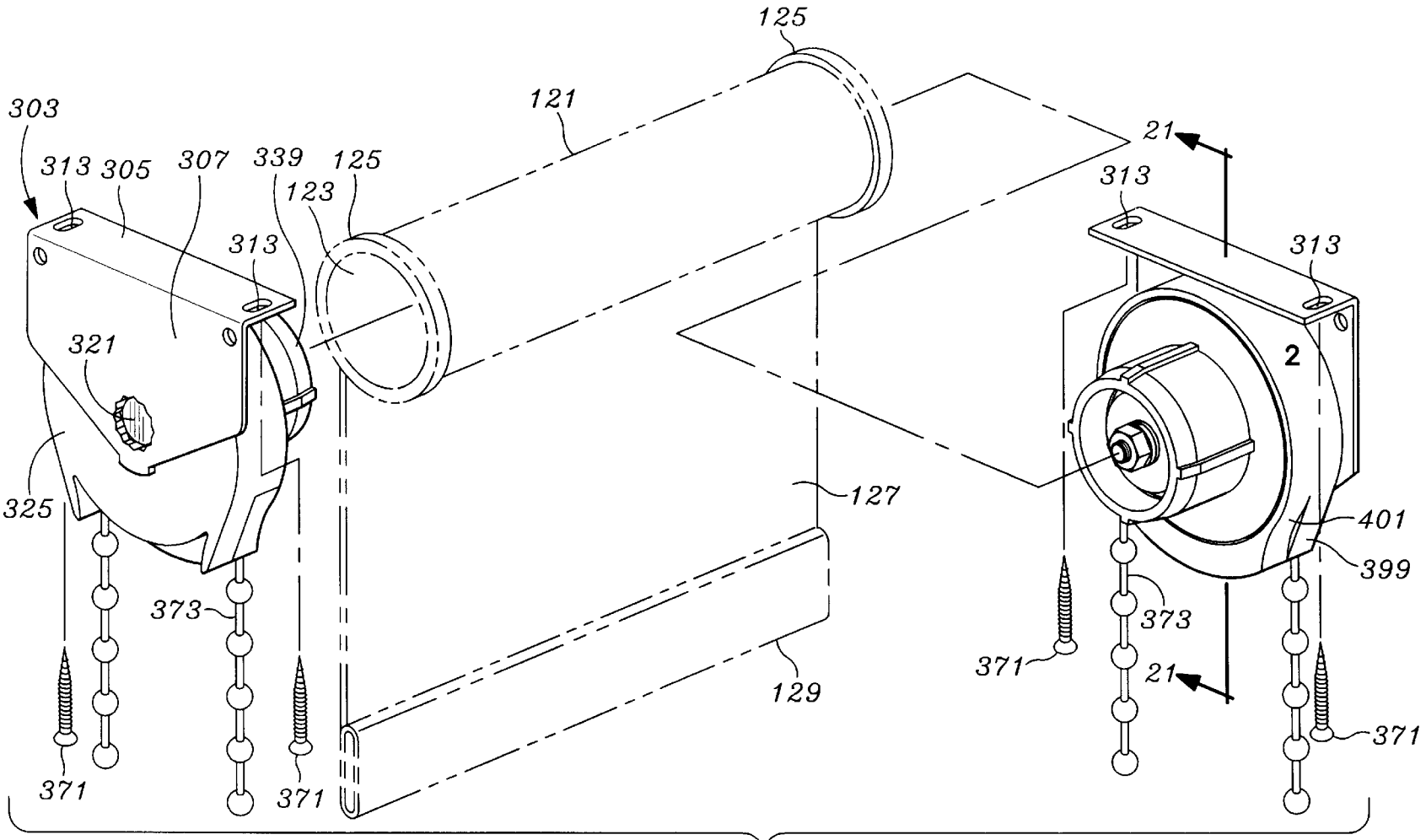
FIG. 20 illustrates a pair of roller shade controls in position to engage a roller shade seen in phantom.

FIG. 20 illustrates a pair of roller shade systems 301 in position to engage a roller shade tube assembly 121 seen in phantom. The roller shade systems 301 are show in assembled position. The use of a pair of identical systems will spread the holding force to keep the roller shade tube assembly 121 fixed in any position. By spreading the holding force, the holding force halved for each of the systems 301 and need not be as tightly controlled in any one system 301. One of the purposes of the double roller bearing design is to reduce higher friction from concentration in any given end and to thus cause the frictional control range to be less sensitive to the torque placed on the bolt 315. This achieves two purposes. First, the system 301 is less sensitive to an over torquing or under torquing of the nut 369. Second, the lesser friction experienced by a given system 301 translates into less back torque which would otherwise urge the components 353, 365, 367, and 369 to unwind or loosen. Thus the use of system 301 makes for a more stable, more secure, and more evenly balanced roller shade assembly 409.

Figures 21, 22, 23, 24, 25:
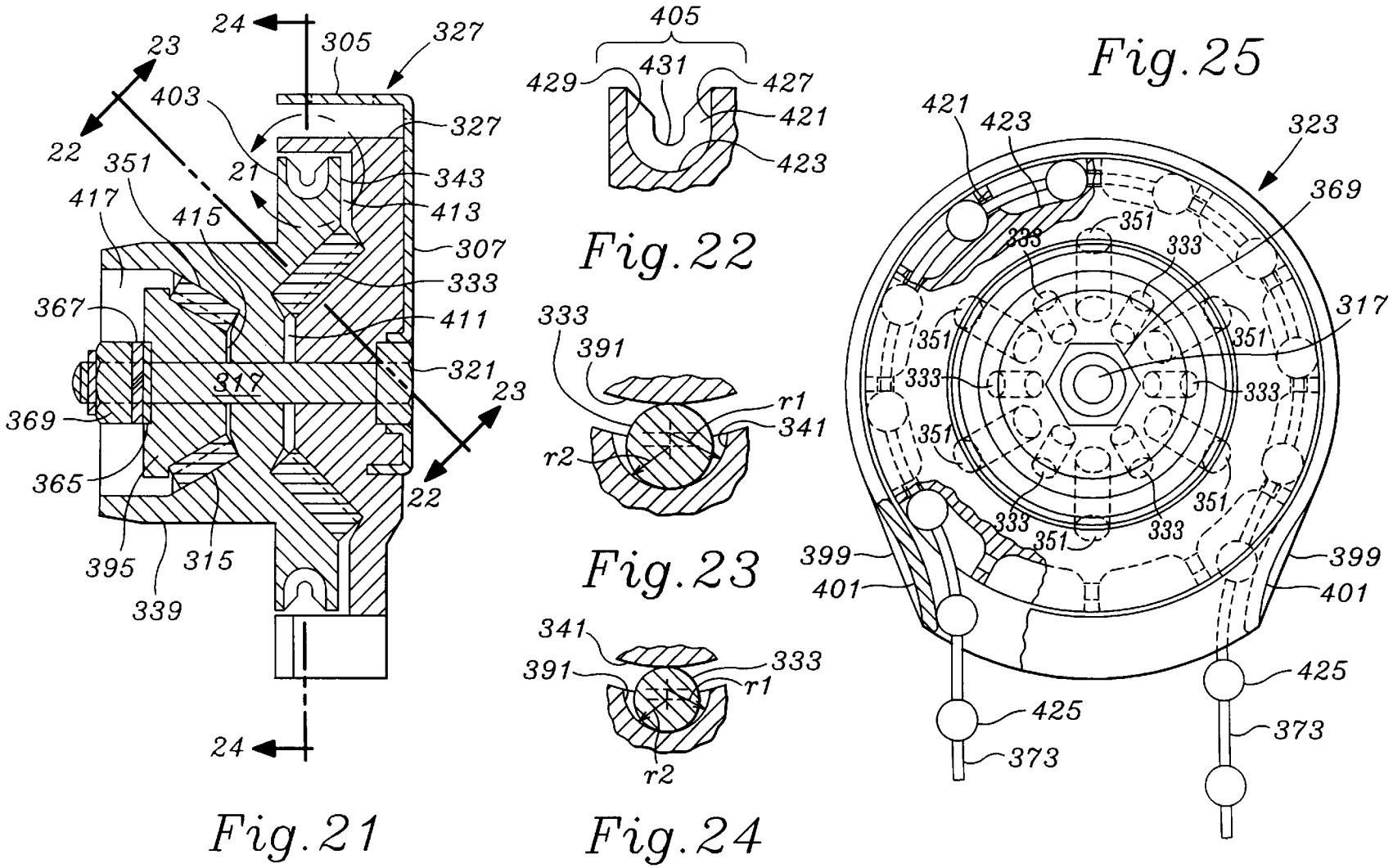
FIG. 21 is a side sectional view taken along line 21—21 of FIG. 20 and illustrating further internal details of the roller shade mechanism seen in FIGS. 19 and 20 shown in assembled view.
FIG. 22 is an expanded view taken along line 22—22 of FIG. 21 and illustrate the use of a single barrier with deep cup to more universally and securely grasp ball chain which is preferred with the mechanism of the instant invention.
FIG. 23 is a sectional view taken along line 23—23 of FIG. 21 and looking down a tapered rounded slot which tapers more narrowly in the direction of view to accommodate a tapered or frusto-conical roller.
FIG. 24 is a sectional view taken along line 24—24 of FIG. 21 and looking into and toward the wider portion of a tapered rounded slot which tapers more widely in the direction of view to accommodate the larger end of the tapered or frusto-conical roller.
FIG. 25 is a semi-sectional view taken along line 25—25 of FIG. 21 and illustrating the relative position of roller bearings as one set being staggered with respect to the other set, with each roller bearing located at a position between any two adjacent roller bearings.

FIG. 21 is a side sectional view taken along line 21—21 of FIG. 20 and illustrating further internal details of the roller shade mechanism seen in FIGS. 19 and 20 shown in assembled view. Note that the contact between the bearing supported sprocket 335 and the main housing 323 is only through the roller bearings 333 and that a readily seen clearance space 411 exists adjacent the bolt 315 and a clearance space 413 exists circumferentially outwardly of the roller bearings 333. Likewise, the contact between the bearing supported sprocket 335 and the conical bearing structure 353 is only through the roller bearings 351 and that a readily seen clearance space 415 exists adjacent the bolt 315 and a clearance space 417 exists circumferentially outwardly of the roller bearings 333.

FIG. 22 is an expanded view taken along line 22—22 of FIG. 21 and illustrate the use of a single section of chain pulley 401 in order to illustrate a barrier 421 with deep trough 423 which is used to capture the ball portions 425 (seen in FIG. 25) of the ball chain 373. As will be seen, there is sufficient barrier 421 spacing and sufficient trough 423 length to enable the ball chain 373 to to more universally and securely grasp ball chain 373, and insure that binding will not occur in the event that one or two of the ball portions 425 of the ball chain 373 are unevenly spaced. The pulley 405 then has a series of circumferentially outwardly directed series of troughs separated by a series of barriers, each barrier extending from a first internally directed side wall 427 of the trough to a base of the trough (touched by lead line of 423) to a second internally directed side wall of said trough 429. Each of the barriers 421 has a ball rope clearance groove 431 to accommodate the rope portion of the ball rope chain 373.

FIG. 23 is a sectional view taken along line 23—23 of FIG. 21 and looking down tapered rounded slot 341 which tapers more narrowly in the direction of view to accommodate tapered or frusto-conical roller bearing 333. As before, with straight or cylindrical roller bearings 187, the tapering slots 241 are formed with a larger radius circle r2 such that the radial center point is displaced slightly more toward the open entrance of the slot 241. This condition holds true for each extent of the length of the slot 241. The slot 241 tapers, but the taper is matched by the taper of the roller bearing 333.

FIG. 24 is a sectional view taken along line 24—24 of FIG. 21 and looking into and toward the wider portion of a tapered slot 341 which tapers more widely in the direction of view to accommodate the larger end of the tapered or frusto-conical roller bearing 333.

FIG. 25 is a semi-sectional view taken along line 25—25 of FIG. 21 and illustrating the relative position of roller bearings 333 and 351 as one set being staggered with respect to the other set, with each roller bearing located at a position between any two adjacent roller bearings. Also seen in broken away section is the ball chain 373 and the ball portion 425 seen with respect to the barrier 421 spacing and 423.

Figure 26:
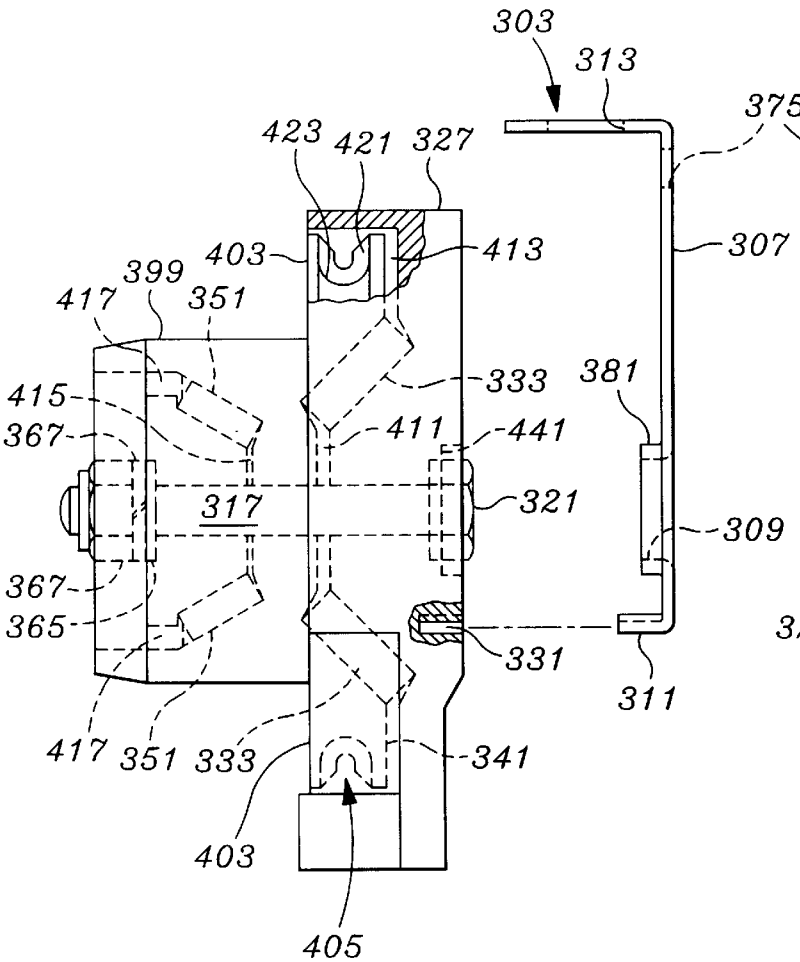
FIG. 26 is a side view in partial section and illustrating the interfitting of an external bolt stabilization bracket having a portion of its material intermitting into the bearing housing and between the bearing housing and the head of a bolt to rotationally stabilize the bolt.

FIG. 26 is a side view in partial section and illustrating the interfitting of the external bolt stabilization bracket 303 having a portion of its material as raised annular boss portion 381 interfitting into the housing 323. Also seen is a chamfer 431 of depth to accommodate the raised annular boss portion 381. Thus, the raised annular boss portion 381 fits between the housing 323 and the bolt head 321. of a bolt to rotationally stabilize the bolt 315. The clearance spaces 411, 413, 415 and 417 are more readily seen.

Figure 27:
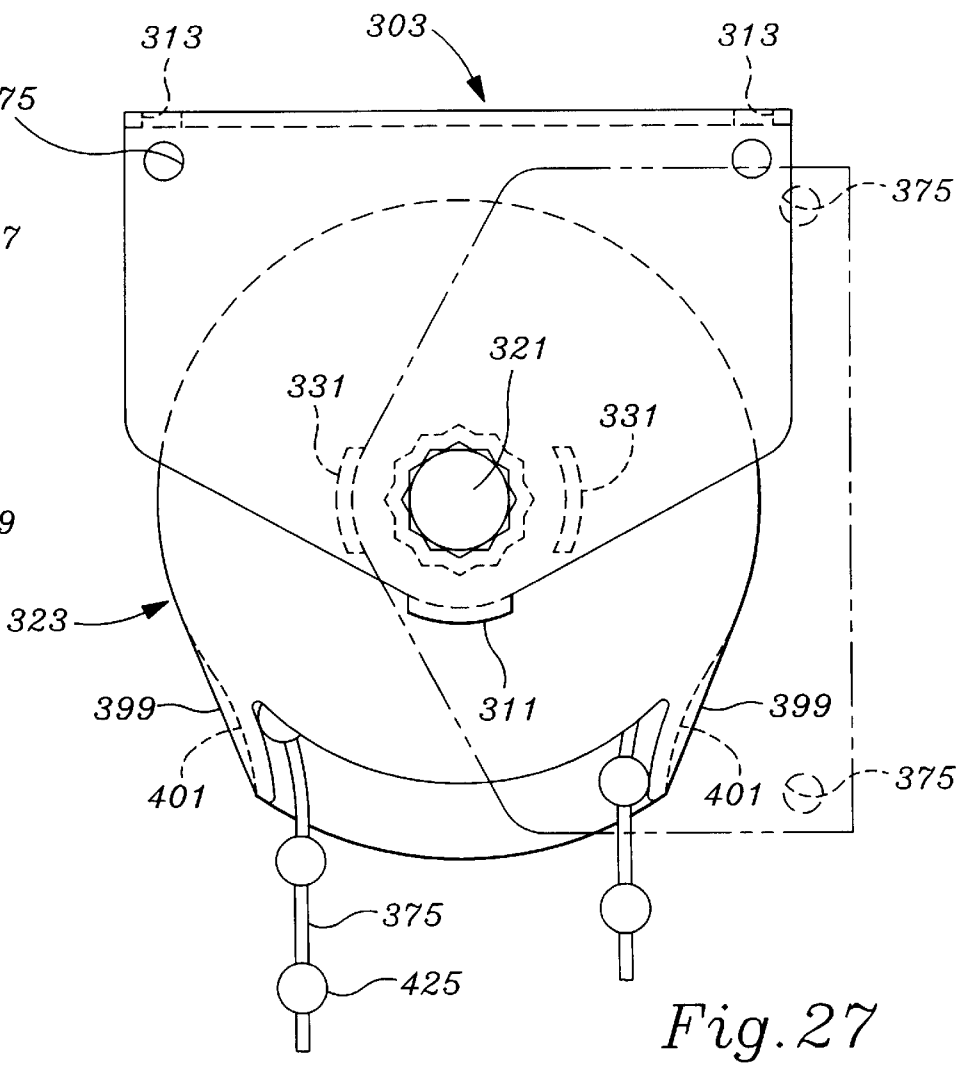
FIG. 27 is an end view showing a mounting of the bearing housing with respect to the bracket where the bracket supports the bearing housing from a position above the housing and a phantom view of the bracket rotated 90° where the housing is mounted from a position laterally adjacent the housing, the other lateral position of support being a mirror image of the view of FIG. 27.
Figure 29:
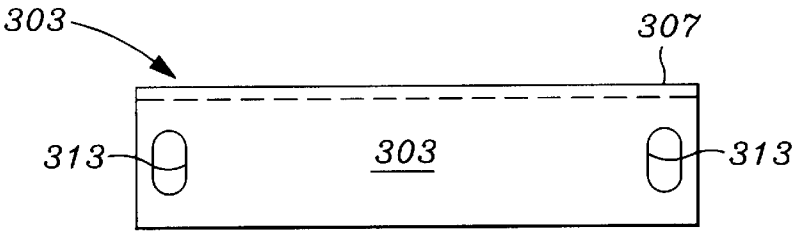
FIG. 29 is a top view of the bracket of FIG. 28.
Figure 28:
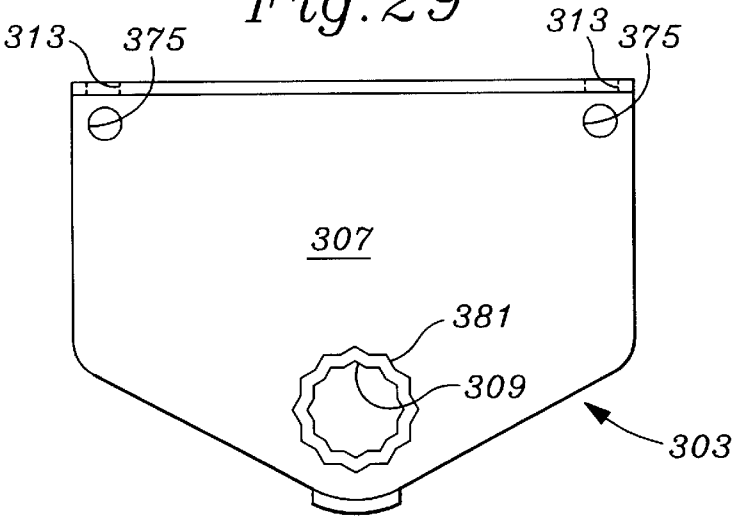
FIG. 28 is an end view of the bracket seen in FIGS. 26 and 27 and illustrating the annular double hex projection.
Figure 30:
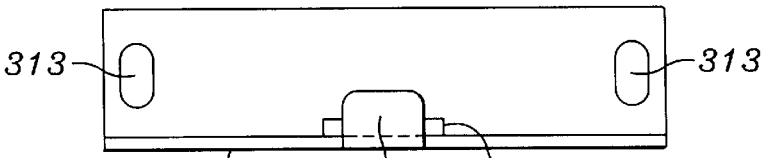
FIG. 30 is a bottom view of the bracket of FIG. 28.
Figure 31:
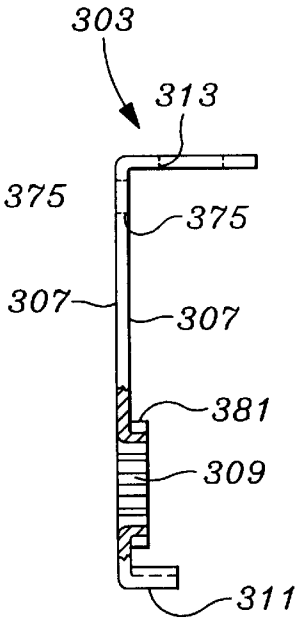
FIG. 31 is a partial sectional side view of the bracket of FIG. 28 and showing details of the annular double hex projection; and, FIG. 32 is a back view of the bracket of FIG. 28.
Figure 32:
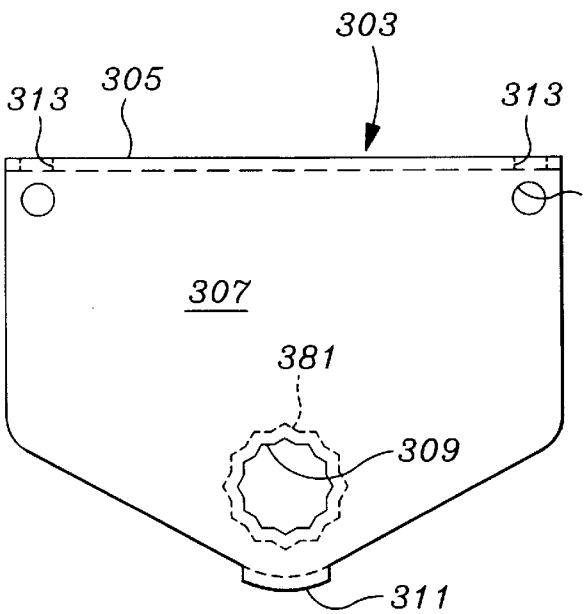

FIG. 27 is an end view showing a mounting of the housing 323 with respect to the bracket 303 where the bracket supports the housing 323 from a position above the housing 323 structure and a phantom view of the bracket rotated 90° where the housing 323 support is mounted from a position laterally adjacent the housing 323, the other lateral position of support being a mirror image of the view of FIG. 27;

FIG. 28 is an end view of the bracket 303 seen in FIGS. 26 and 27 and illustrating the annular double hex projection 318. FIG. 29 is a top view of the bracket 303 seen in FIG. 28. FIG. 30 is a bottom view of the bracket 303 of FIG. 28 and prominently illustrating the lower cantilevered key 311. FIG. 30 is a partial sectional side view of the bracket 303 of FIG. 28 and showing details of the annular double hex projection 318. FIG. 31 is a side sectional view of the bracket 303 of FIG. 28. FIG. 32 is a back or wall facing view of the bracket of FIG. 28 and cleanly illustrating the double hexagonal bore 309 with the annular double hex projection 318 shown in phantom. It is understood that the double hex projection 318 and its double hexagonal bore 309 can be made as a regular hexagonal opening, or any other bolt head opening, but that the double hexagonal nature of the bore 309 and projection 318 makes for more even punching, can provide stronger turning resistance (wrench effect) with lesser depth, and is able to better utilize the periphery of the material about the bore 309.

The system 301 has been described with respect to roller bearings 333 and 351 which create the clearance spaces 411, 413, 415 and 417 due to the use of roller bearings 333 and 351 which are of sufficient diameter to undertake all of the bearing force, when they are present. If the roller bearings 333 and 351 are not present, then the generally conical surface 399 can be set to frictionally engage the general conical surface 345, and the conical surface 359 and the generally conical surface 407. In this instance, it may be desirable to provide some lubrication between the complimentary surfaces, in the form of a liquid, a graphite or similar suspension, or a lubricating insert.

Figure 33:
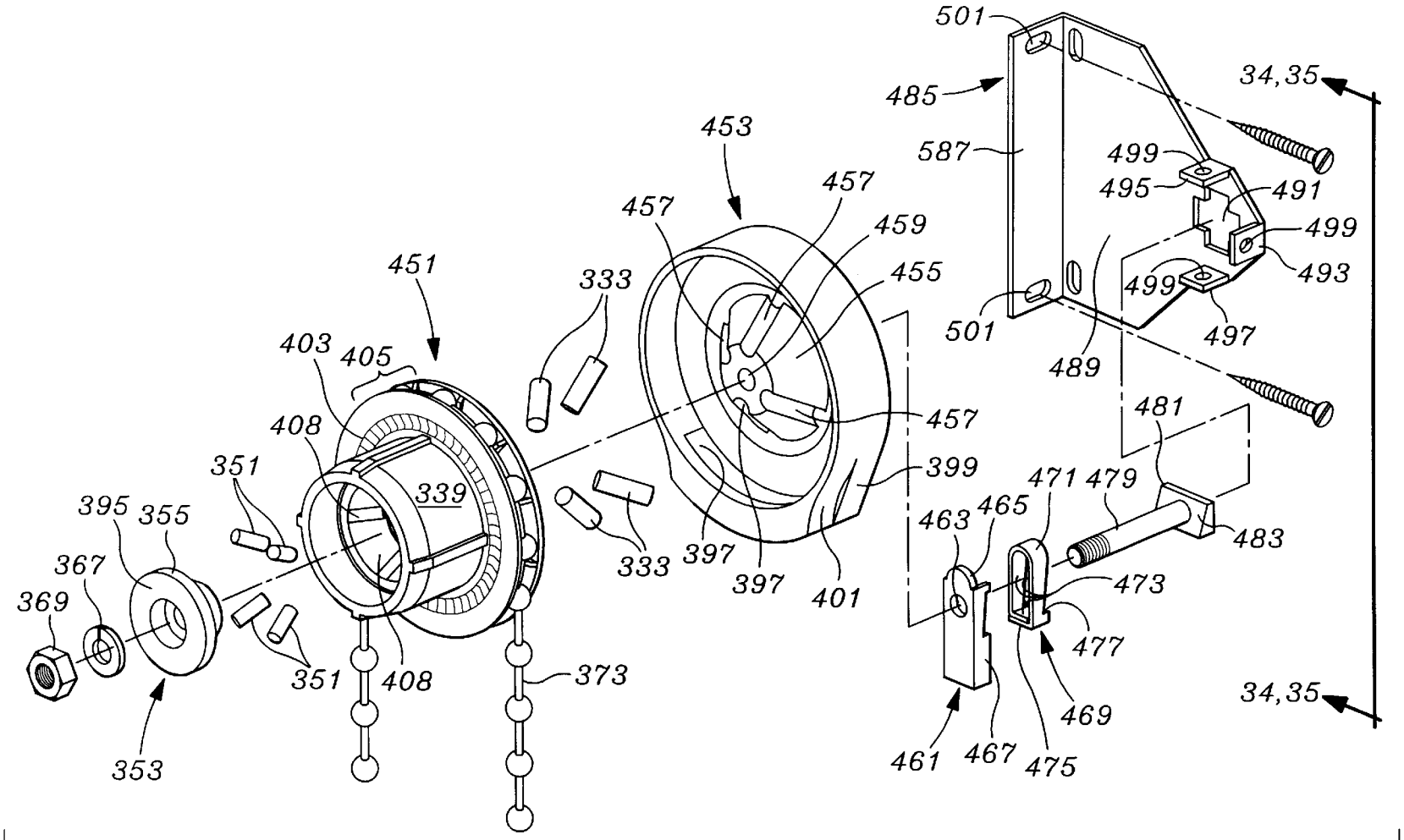
FIG. 33 is an exploded view similar to that of FIG. 19, but illustrating a bracket and bolt assembly which enables both a four position mounting of the bracket and combined with an adjustment mechanism using a translatable wedge for adding and subtracting tension from a main bolt.

Referring to FIG. 33 a view of a system 445 which differs in several respects to the other systems 21, 101, & 301. Numbering will be in accord with the system 301 where the structure has not changed. First, the system 445 illustrated is similar to the view of FIG. 19, but where only four roller bearings 333 and 351 are seen. In addition, of the slots 408 and 341 which were both included in the surfaces of the bearing supported sprocket 335, only one set of slots 408 remain on a bearing supported sprocket 451. To the right of the bearing supported sprocket 451, a main housing 453 is seen. Instead of the completely conical surface 391, a conical bearing structure 455 is seen as supporting a set of four slots 457. A small radial surface 459 which is at the frustrated apex of the conical bearing structure 455 is seen as being invaded with the uppermost ends of the slots 457.

To the right and below the main housing 453, a wedge stabilization bracket 461 is seen as having a bolt accommodation aperture 463. Wedge stabilization bracket 461 has a curved upper portion 465, and a pair of angled side portions 467, one of which can be seen in FIG. 33. Just to one side of the wedge stabilization bracket 461 is seen a wedge 469 which is upwardly and downwardly, from the perspective of the orientation of FIG. 33, translatable within the open end of the wedge stabilization bracket 461. Note that whereas the wedge stabilization bracket 461 has a single aperture 463 to interfit closely with a cylindrical structure, that wedge 469 has an upper curving portion 471 which forms and overlies an elongate vertical slot 473. Wedge 469 has a flattened bottom 475, shown as a pair of folded over leaves or end portions. Wedge 469 has a front boot stop 477 which will be shown to interact with another structure and form a stop with respect to the upward movement of the wedge 469.

To the right of the wedge 469, a main bolt 479 is seen as having a head 481 with an inclined lower surface 483. The slope of the inclined lower surface 483 matches the slanted surface of the wedge 469 facing the head 481. Thus, as the wedge 469 moves up and down vertically, the head 481 moves to the left or right to increase and decrease tension along the main length of the main bolt 479.

To the right of and slightly up from the bolt 479 is a mounting bracket 485. The mounting bracket 485 includes an abbreviated width upper member 487 and a main planar expanse 489. At one end of the main planar expanse 489, a cross-shaped bore 491 supports a lower cantilevered key 493, and a pair of side cantilevered keys 495 and 497. Each of the keys 493, 495 and 497 has a threaded bore 499. Mounting bracket 485 includes a pair of upper mounting apertures 501. A notch 494 is provided for clearance.

Figure 34:
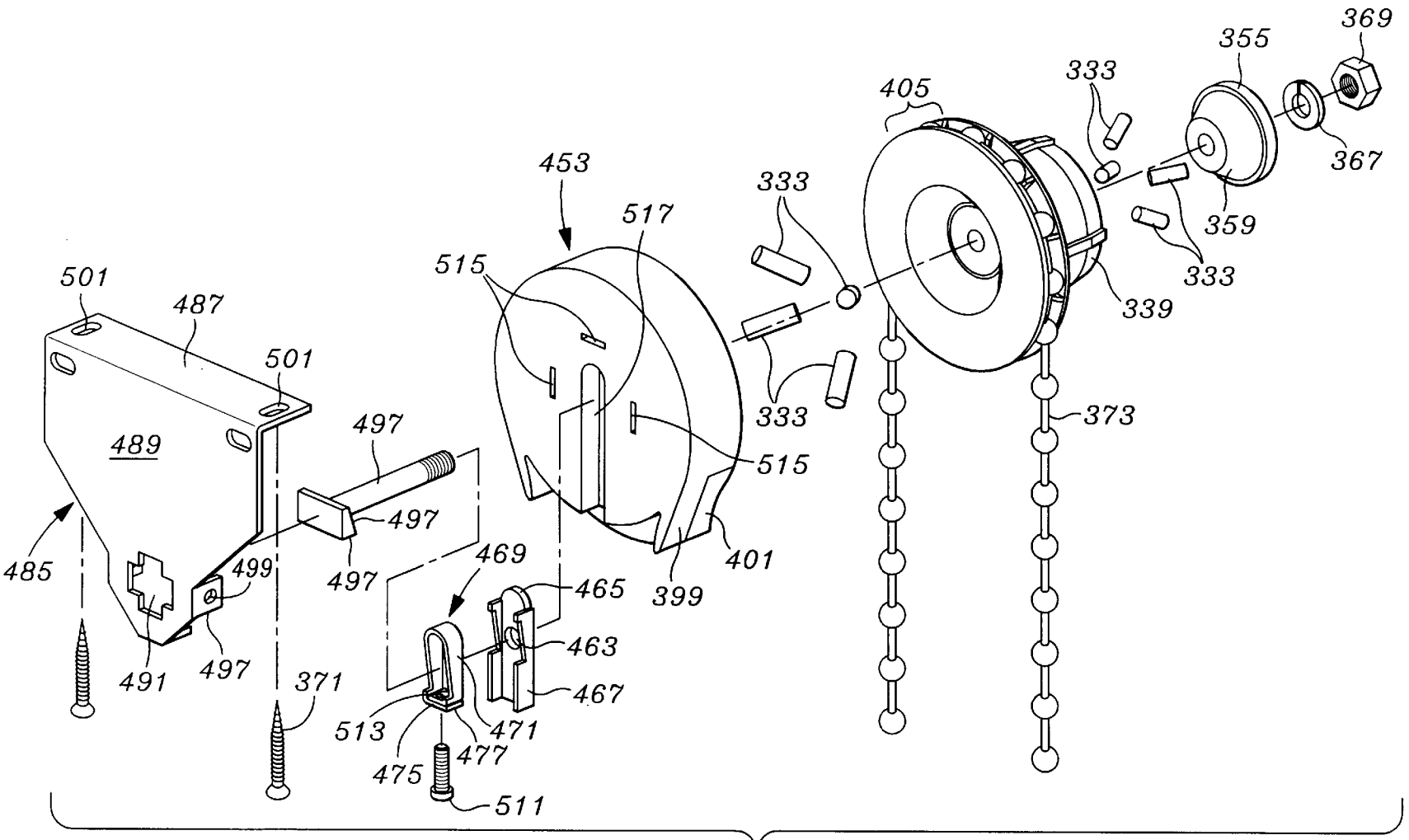
FIG. 34 is an exploded view in reverse with respect to FIG. 33, and illustrating further details of the bracket and bolt assembly and accommodation of both a four position mounting of the bracket and combined with an adjustment mechanism using a translatable wedge for adding and subtracting tension from a main bolt.

Referring to FIG. 34 an exploded view in reverse with respect to FIG. 33 illustrates further details of the bracket 485 and bolt 479 assembly and accommodation of both a four position mounting of the bracket 485 with respect to main housing 453, in addition to the operation of the wedge 469. A tension set screw 511 is seen with respect to a threaded bore or aperture 513. When the tension set screw 511 fits through any of the apertures 499, the wedge 469 will be pulled downward to cause the head 481 to pull tension on the main bolt 479.

The side of the main housing 453 opposing the mounting bracket 485 contains a series of three narrow slots 515, and an elongate slot 517. The width and thickness of the keys 493, 495 and 497 matches the width and thickness of the three narrow slots 515. The elongate slot 517 has a width matching the keys 493, 495 and 497. Elongate slot 517 accommodates both the wedge stabilization bracket 461 and the wedge 469. Note that the upper portion of the elongate slot 517 is rounded to fit with curved upper portion 465 of the wedge stabilization bracket 461. The wedge 469 operates by moving back and forth along the elongate slot 517, but generally within the wedge stabilization bracket 461. The placement of the three narrow slots 515 and the elongate slot 517 enable the set screw 511 to approach entry into the wedge 469, through the lower portion of the elongate slot 517 when the bracket 485 is in three of the four possible positions. This is because there is no key opposite the key 493. There should not be an instance where the upper member 487 must be positioned opposite the lower open end of the elongate slot 517. Since the lower end of the elongate slot 517 is normally expected to be directed downwardly, and using the orientation of main housing 453 as a starting point, it can be seen that the bracket 485 and its keys 493, 495 and 497 can be inserted into mating position with respect to the main housing 453 in any of four orientations. The three working orientations include cases where the upper member 487 is upwardly oriented as seen in FIG. 34, as well as where the upper member is oriented to the left or right side of the main housing 453. As has been stated, a position where the upper member 487 is located in the downward position is not expected to work since the tension set screw 511 will have no key against which to engage the bore or aperture 513. With this configuration, the bracket 485 can be used at either end of a roller shade, and at either end can be used to depend from a front wall or structure, a rear wall or structure, or a tope ceiling, wall, or structure.

Also seen in FIG. 33 on the bearing supported sprocket 451, is a radially positioned indentation 519 on the side where the cylindrical insertion member 339 extends from the sprocket 451. This structure acts as a guide to help the shade material 127 wind straight and properly on the hollow tube 123, which was seen in FIG. 20.

Figure 36:
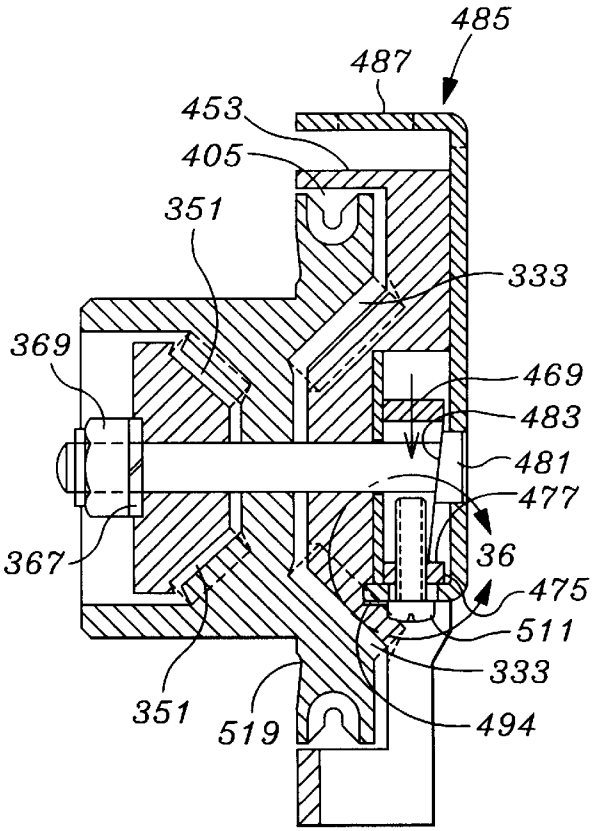
FIG. 36 is a side sectional view taken along line 36—36 of FIG. 33 and illustrating the action of the wedge assembly in its final, downward with respect to viewing of FIG. 36, position and after the translatable wedge adds all of its tension to the main bolt by urging the head of the main bolt in the direction of the bracket.
Figure 35:
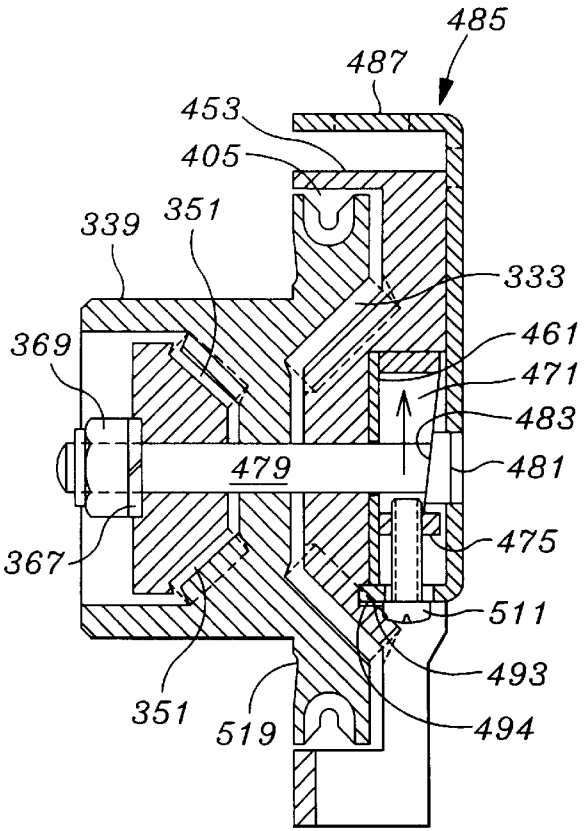
FIG. 35 is a side sectional view taken along line 35—35 of FIG. 34 and illustrating the action of the wedge assembly in its initial, upward with respect to viewing of FIG. 35, position and before the translatable wedge adds tension to the main bolt.

Referring to FIG. 35, a side sectional view taken along line 35—35 of FIG. 34 and illustrates the action of the wedge assembly wedge 469 in its initial, upward position with respect to viewing of FIG. 35, position and before the translatable wedge 469 moves down to add tension to the main bolt 479. FIG. 36 is a side sectional view taken along line 36—36 of FIG. 33 and illustrating the action of the wedge assembly wedge 469 in its final, downward motion with respect to viewing of FIG. 36, position and after the translatable wedge 469 adds all of its tension to the main bolt 479 by urging the head of the main bolt 479 in the direction of the bracket 485.

Figure 37:
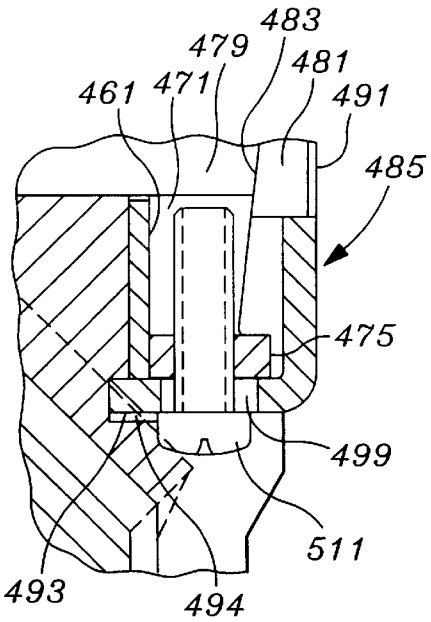
FIG. 37 is a closeup view taken along line 37 of FIG. 36 and illustrating the operation of the wedge against the slanted underside of the main bolt.

FIG. 37 is a closeup view taken along line 37 of FIG. 36 and illustrating the operation of the wedge 461 against the slanted underside 483 of the head 481 main bolt 479.

Figure 39:
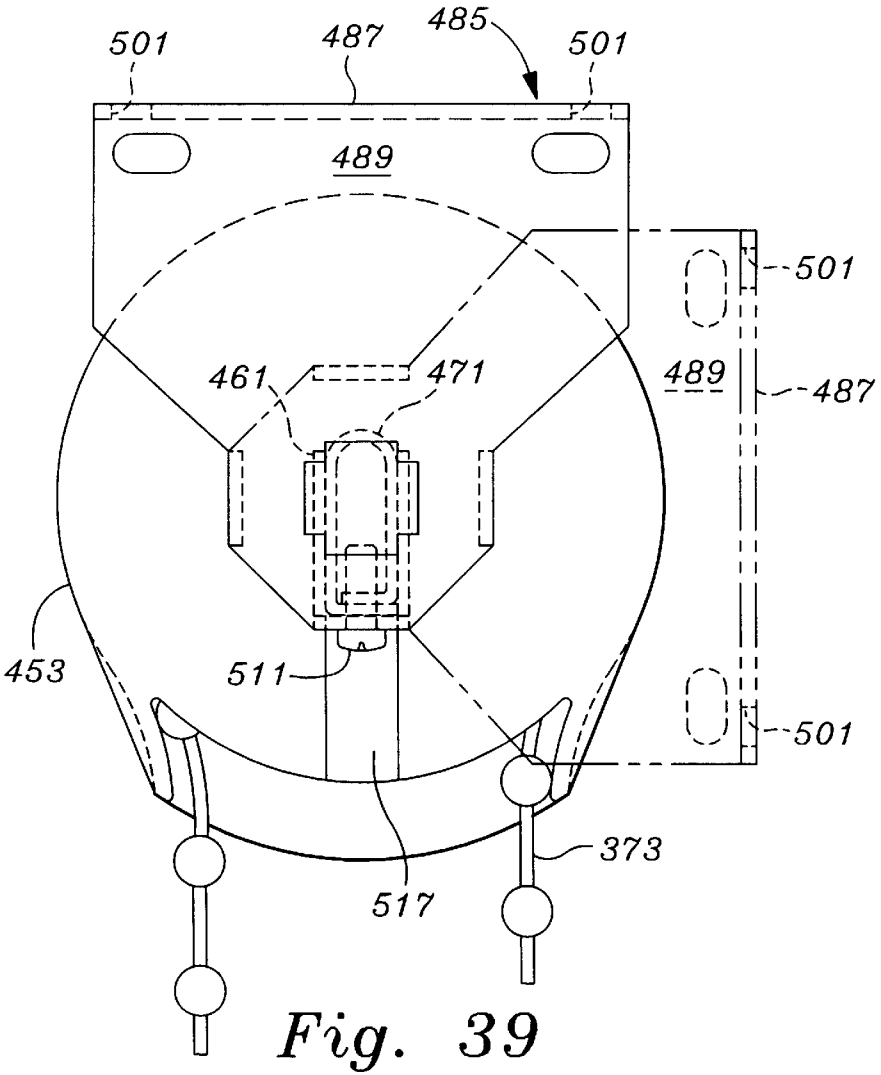
FIG. 39 is an end view and illustrating the 90° symmetry or angular engagement of the bracket which allows supported structures to be supported from a end, upper, rear, front, or below.
Figure 38:
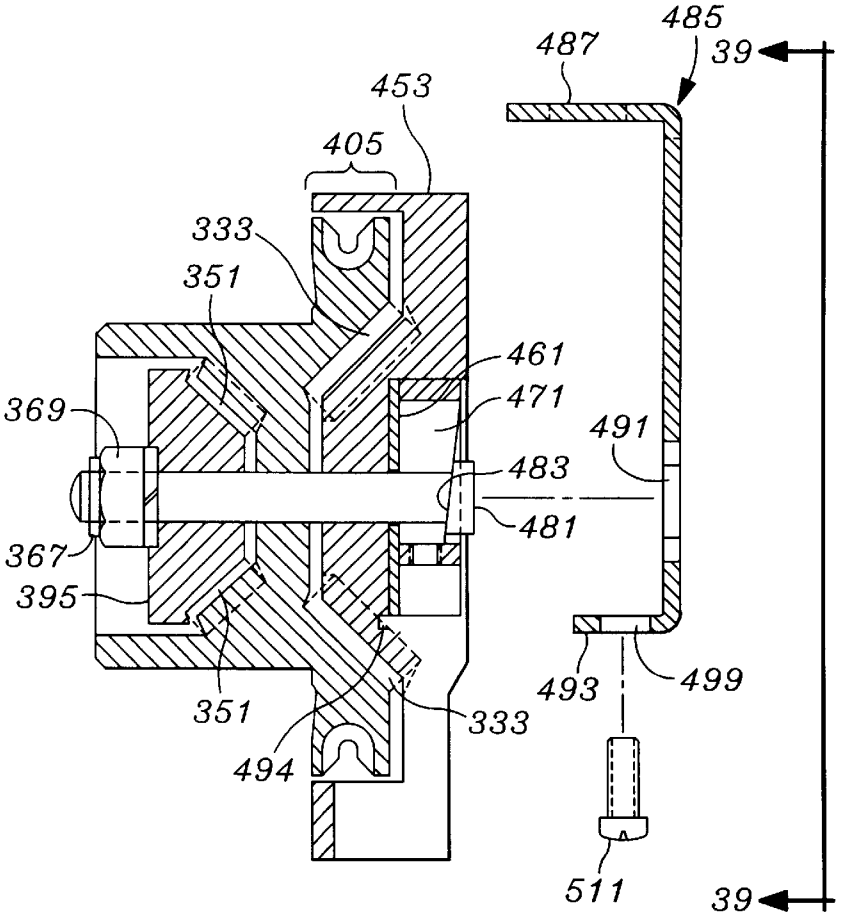
FIG. 38 is a side sectional exploded view in accord with the position seen in FIG. 35, and illustrating that the bracket goes it before the adjustment screw is added from below.

FIG. 38 is a side sectional exploded view in accord with the position seen in FIG. 35, and illustrating that the bracket 485 and the keys, especially key 493 goes in before the tension adjustment set screw 511 is added from below. FIG. 39 is an end view and illustrating the 90° symmetry or angular engagement of the bracket 485 which allows supported structures to be supported from a end, upper, rear, front, or below.

Figures 40, 41, 42, 43, 44, 45, 46:
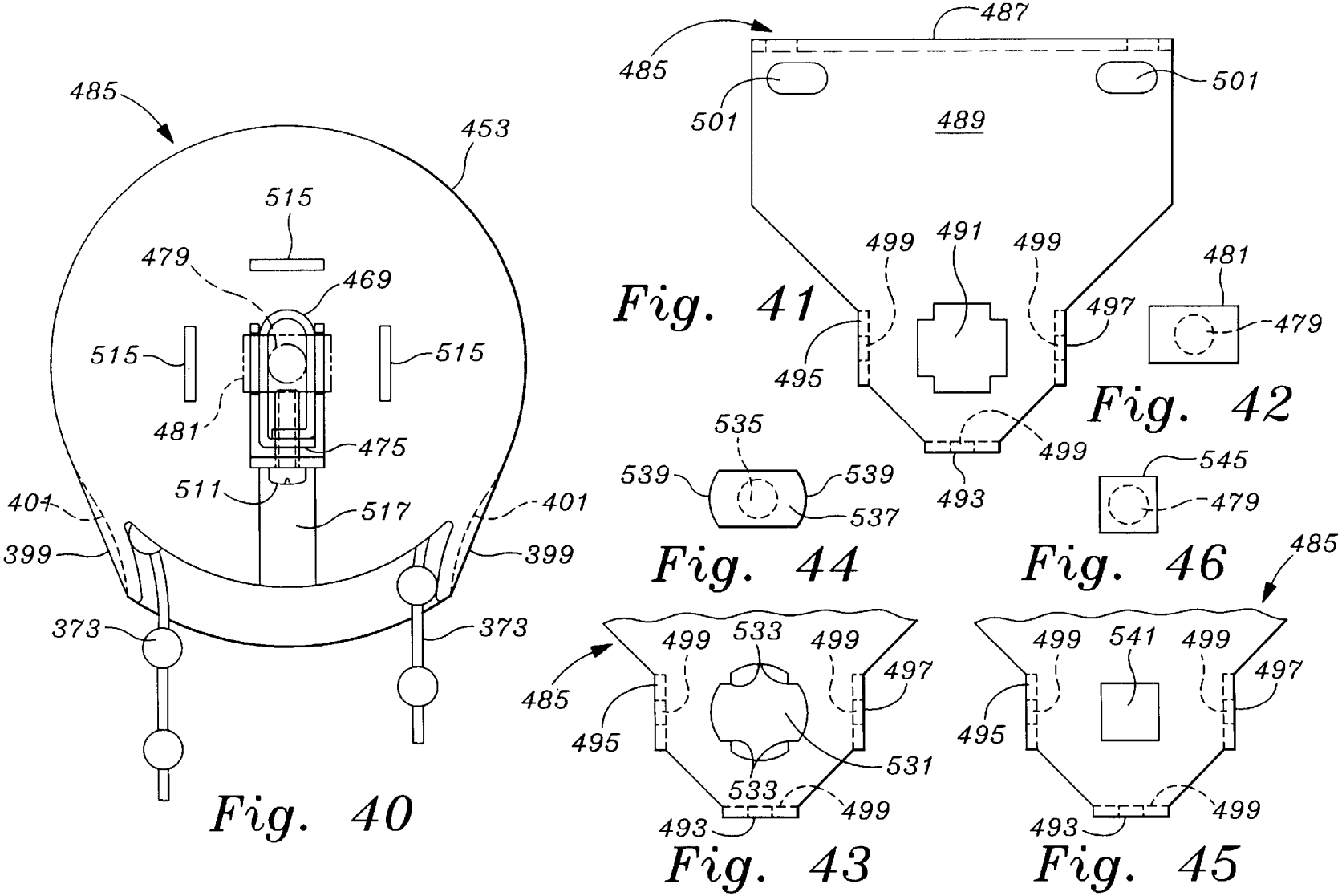
FIG. 40 is an end view with the bracket removed and illustrating the relative position of the wedge member with respect to the bolt, bolt head, and engagement slots of the housing.
FIG. 41 is an end view of the bracket shown in FIGS. 33–38 and which illustrates the 90° symmetry facilitated.
FIG. 42 is an end view of the main bolt interfittable with the opening of the bracket of FIG. 41 and shown in close proximity to facilitate visualization of the 90° symmetry facilitated.
FIG. 43 is an end view of a lower portion of a bracket similar to the bracket shown in FIG. 41 and which illustrates the 90° symmetry facilitated.
FIG. 44 is an end view of a main bolt having curved opposite surfaces and interfittable with the opening of the bracket of FIG. 43 and shown in close proximity to facilitate visualization of the 90° symmetry facilitated.
FIG. 45 is an end view of a lower portion of a bracket similar to the bracket shown in FIG. 41 and which illustrates the 90° symmetry facilitated.
FIG. 46 is an end view of a main bolt having a square shape and interfittable with the opening of the bracket of FIG. 43 and shown in close proximity to facilitate visualization of the 90° symmetry facilitated.

FIG. 40 is an end view of the main housing 453 with the bracket 485 removed and illustrating the relative position of the wedge 469 with respect to the bolt 479, bolt head 481. Wedge 469 is shown in mid-position. The angle of the engagement surfaces of the wedge 469 match the angle of the inclined lower surface 483 of the head 481 of the main bolt 479. These angles can be in any amount and will depend upon the operating range of tension in the bolt 479 desired for a given displacement of the wedge 469. Using most materials, the angle should be severe enough to give an acceptable tension adjustment, but without undue stress on the tension adjustment set screw 511. It should also be kept in mind that once the upper limit of adjustment is made by use of the tension adjustment set screw 511, the user should then ideally reverse the position of the tension adjustment set screw 511 to completely loosen tension, and then screw the nut more securely onto the bolt 479 to increase the overall tension on the bolt 479, and then again resort to the tension adjustment set screw 511 to make small range adjustments.

A more shallow angle of the wedge 469 with respect to the bolt head 481 surface 483, all other things being equal, will limit the fine adjustment range. The force necessary to make the adjustment depends not only on the angle of the wedge 469 with respect to the surface 483, but also the pitch of the tension adjustment set screw 511. A pitch of about 0.7 mm has been found to work well with an angle in the range of from about 7 degrees to about 15 degrees for the angle of the wedge 469 with respect to the bolt head 481, from a plane perpendicular to the axis of the bolt 479. A more preferable range is from about 9 degrees to about 13 degrees from a plane perpendicular to the axis of the bolt 479. A most preferable angle is about 11 degrees from a plane perpendicular to the axis of the bolt 479.

The engagement of the wedge 469 with respect to the surface 483 is typically limited to the side edges of the upper "U" shape of the wedge 469 and against only two narrow widths of the surface 483. This is best seen in FIG. 33 where the engaging surfaces of the wedge 469 face the surface 483. As will be seen, the shape of the head 481 need only be sufficient to enable the two slanted side portions of the wedge 468 engage mating surfaces on the surface 483. The overall shape of the head 481 of the bolt 479 need only have 90° stepped engagement with the cross shaped bore 491.

Referring to FIG. 41, an end view of the bracket shown in FIGS. 33–38 is seen and where the cross shaped bore 491 is seen. Remember also that with the inclined lower surface 483 that an expanded side edge of the head 481 is available to engage the lower edge of the cross shaped bore 491 and which illustrates the 90° symmetry facilitated.

FIG. 42 is an end view of the head 481 main bolt interfittable with the bore or opening 491 of the bracket of FIG. 41 and shown in close proximity to facilitate visualization of the 90° symmetry facilitated.

FIG. 43 is an end view of a lower portion of a bracket 485 similar to the bracket shown in FIG. 41, but having a round bore 531 having a series of four spikes 533 which prevents turning of a bolt head within the round bore 531. This pattern also illustrates the 90° symmetry facilitated. FIG. 44 is an end view of a main bolt 535 having a head 537 which is rectangular but has curved ends 539. The shape of the head 537 fits within the round bore 531 and thus 90° symmetry is facilitated.

Referring to FIG. 45, an end view of a lower portion of a bracket 485 similar to the bracket shown in FIG. 41 with a square bore 541 which prevents turning of a bolt head within the square bore 541. This pattern also illustrates the 90° symmetry facilitated. FIG. 46 is an end view of a main bolt 543 having a head 545 which is square. The shape of the head 545 fits within the square bore 541 and thus 90° symmetry is facilitated.

Figure 49:
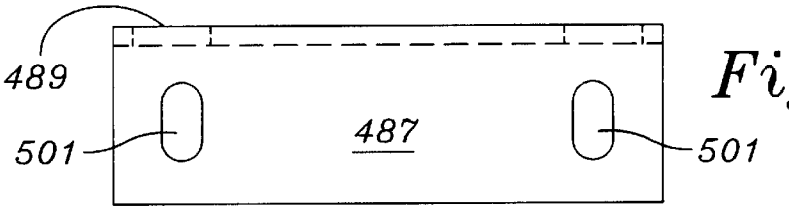
FIG. 49 is a top view of the bracket seen in FIG. 41.
Figure 48:
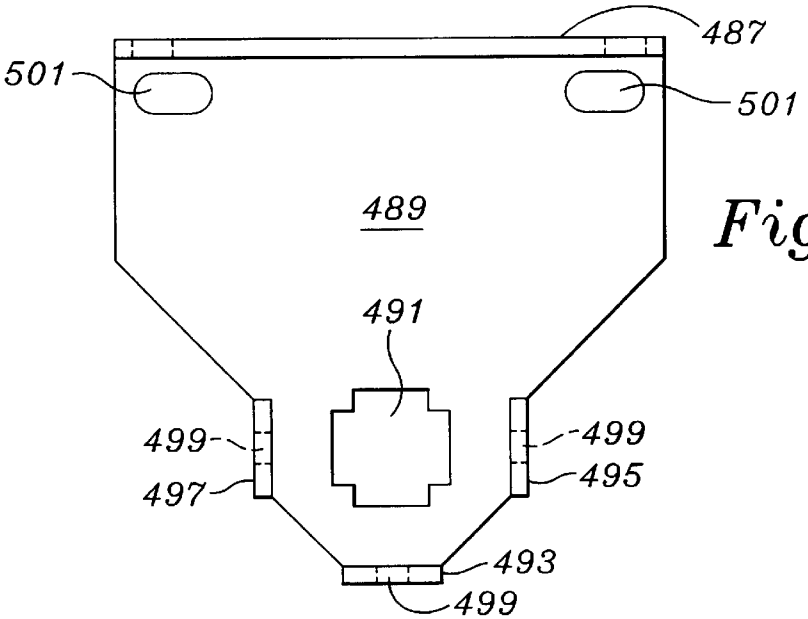
FIG. 48 is a plan view of the opposite side of the bracket which was shown in FIGS. 41.
Figure 50:
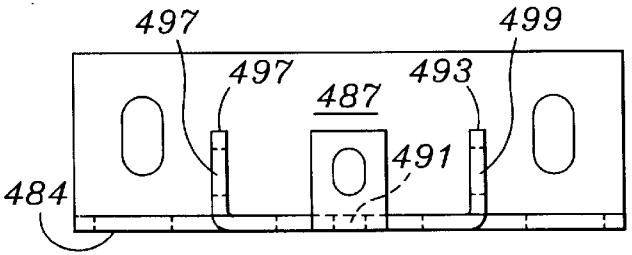
FIG. 50 is a bottom view of the bracket seen in FIG. 41.
Figure 47:
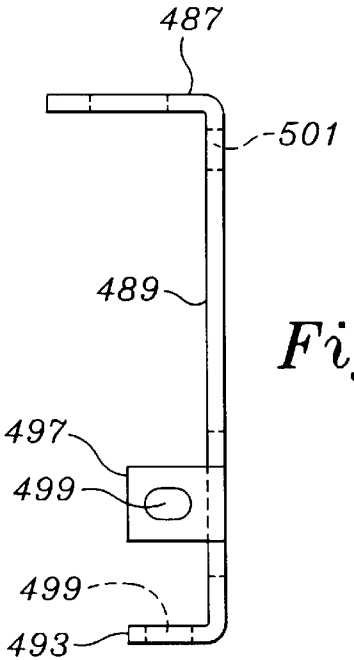
FIG. 47 is a side view of the bracket seen in FIG. 41.

FIG. 47 is a side view of the bracket 485 seen in FIG. 41. FIG. 48 is a plan view of the opposite side of the bracket 485 which was shown in FIG. 41. FIG. 49 is a top view of the bracket seen in FIG. 41. FIG. 50 is a bottom view of the bracket seen in FIG. 41.

Figure 51:
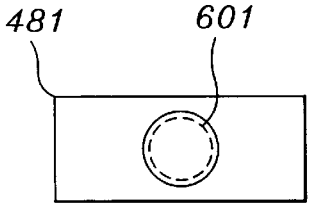
FIG. 51 is an end view of the main bolt of FIGS. 34–36 & 38 shown for direct comparison to the surrounding Figures and comparison to various wedges and wedge stabilization brackets shown in subsequent Figures.

FIG. 51 is an end view of the main bolt 479 of FIGS. 34–36 & 38 for direct comparison to the surrounding FIGS. 53–70 and comparison to various further embodiments of the wedges and wedge stabilization brackets shown.

Figure 52:
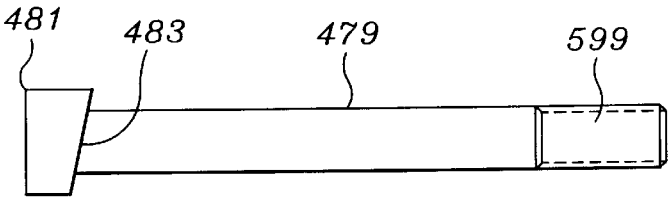
FIG. 52 is a side view of the main bolt of FIG. 51.

FIG. 52 is a side view of the main bolt 479 of FIG. 51 and illustrating the inclined lower surface 483 which will be urged by a wedge 469 or one of the embodiments to be explained, head 481 and an abbreviated length end thread set 599.

Figure 53:
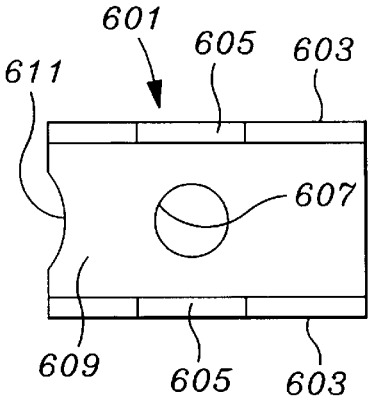
FIG. 53 is a frontal view of a second embodiment of a wedge stabilization block illustrating the front of its side walls, notches in the front of its side walls and an aperture for accommodating the main bolt of FIGS. 51 and 52.
Figure 54:
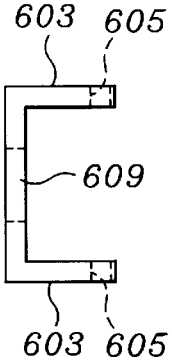
FIG. 54 is a top end view of the wedge stabilization block of FIG. 53 with an upper curved notch, and the side wall notches shown in dashed line format.
Figure 55:
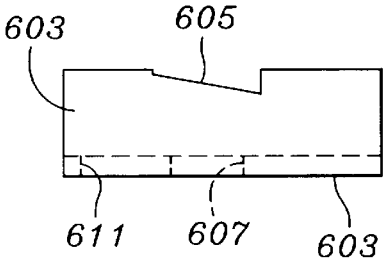
FIG. 55 is a side view of the wedge stabilization block of FIGS. 53 and 54 with an upper curved notch, and the aperture for accommodating the main bolt shown in dashed line format.

FIG. 53 is a frontal view of a second embodiment of a wedge stabilization block 601 illustrating the front of its side walls 603, notches 605 in the front of its side walls 603 and an aperture 607 in a back wall 609 for accommodating the main bolt 479 of FIGS. 51 and 52. An upper curved groove 611 in the top of the wedge stabilization block 601 is also seen. FIG. 54 illustrates a top end view of the wedge stabilization block 601 of FIG. 53. FIG. 55 is a side view of the wedge stabilization block of FIGS. 53 and 54 with the upper curved notch 611, and aperture 609 shown in dashed line format.

Figure 56:
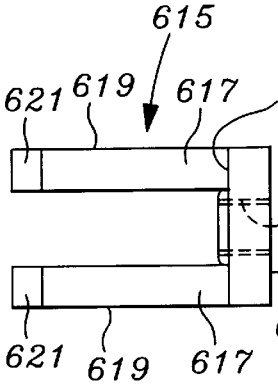
FIG. 56 is a frontal view of a open top wedge utilizable in conjunction with the wedge stabilization block of FIGS. 53–55 and illustrating a pair of inclined front surface side walls for engaging an inclined lower surface of the main bolt, and each of which leads to a small flat front surface, FIG. 56 also illustrating a threaded through bore in a base supporting the side walls.
Figure 57:
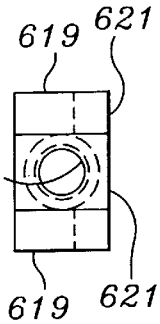
FIG. 57 is a bottom end view of the wedge of FIG. 56 and directly illustrating the through bore of the base, as well as the depth of the side walls.

FIG. 56 is a frontal view of a open top wedge utilizable in conjunction with the wedge stabilization block of FIGS. 53–55 and illustrating a pair of inclined front surfaces 617 on side walls 619 for engaging inclined lower surface 483 of the main bolt, and each of which leads to a small flat front surface 621. FIG. 56 also illustrates a threaded through bore 623 in a base 625 supporting the side walls 619. FIG. 57 is a bottom end view of the wedge 615 of FIG. 56 and directly illustrating the through bore 623 of the base, as well as the depth of the inclined front surfaces 617 of the side walls 619.

Figure 58:
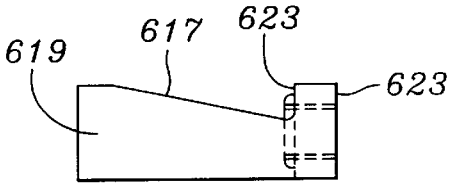
FIG. 58 is a side view and more clearly illustrating the pair of inclined front surface side walls for engaging an inclined lower surface of the main bolt, and the angular relation ship of the inclined front surface of the side walls to the small flat front surface, as well as the transition to a the foot shaped base and showing the threaded through bore in the base in dashed line format.

FIG. 58 is a side view of the wedge 615 and more clearly illustrating the pair of inclined front surface 617 of the side walls 619 for engaging an inclined lower surface 483 of the main bolt, and the angular relation ship of the inclined front surface 617 of the side walls 619 to the small flat front surface 621, as well as the transition to a the foot shaped base 625 and showing the threaded through bore 623 in the base in dashed line format.

Figure 59:
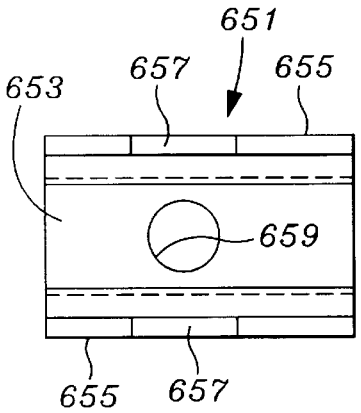
FIG. 59 is a frontal view of a third embodiment of a wedge stabilization block with angled back wall and illustrating the front of its side walls, notches in the front of its side walls and an aperture for accommodating the main bolt of FIGS. 51 and 52.
Figure 60:
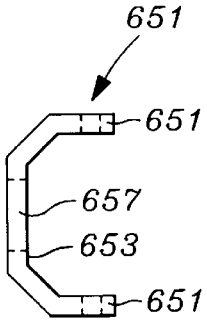
FIG. 60 is a top end view of the wedge stabilization block of FIG. 59 and illustrating the angled, hemi octagonal back wall, and the side wall notches and aperture for accommodating main bolt shown in dashed line format.
Figure 61:
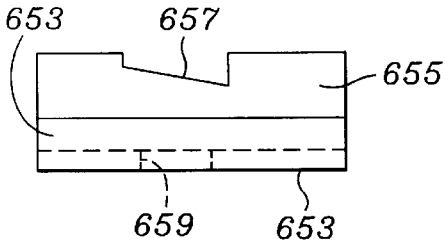
FIG. 61 is a side view of the wedge stabilization block of FIGS. 59 and 60 with the aperture for accommodating the main bolt shown in dashed line format.

FIG. 59 is a frontal view of a third embodiment of a wedge stabilization block 651 with angled back wall 653 and illustrating the front of its side walls 655, notches 657 in the front of its side walls 655 and an aperture 659 for accommodating the main bolt 479 of FIGS. 51 and 52. FIG. 60 is a top end view of the wedge stabilization block 651 of FIG. 59 and illustrating the angled, hemi octagonal back wall 653, and the side wall notches 657 and aperture 659 for accommodating main bolt 479 shown in dashed line format. FIG. 61 is a side view of the wedge stabilization block 651 of FIGS. 59 and 60 with the aperture 658 for accommodating the main bolt shown in dashed line format, and with the hemi-octagonal rear wall 653 clearly seen.

Figure 62:
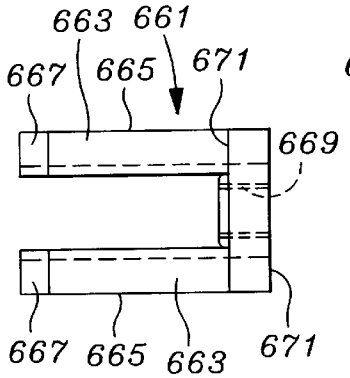
FIG. 62 is a frontal view of a open top wedge utilizable in conjunction with the wedge stabilization block of FIGS. 59–61 and illustrating a pair of inclined front surface side walls for engaging an inclined lower surface of the main bolt, and each of which leads to a small flat front surface, FIG. 62 also illustrating a rearward angled surface on the side walls and whonwn in dashed line format as is a threaded through bore in a base supporting the side walls.
Figure 63:
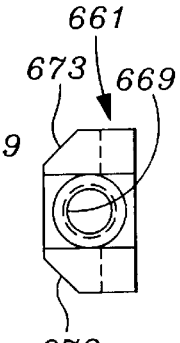
FIG. 63 is a top end view of the wedge of FIG. 62 and directly illustrating the through bore of the base, as well as the depth of the side walls and particularly illustrating the angled nature of the side walls and when compared to FIG. 60, how the angled back side of the side walls interfit with the wedge stabilization block of FIG. 60.
Figure 64:
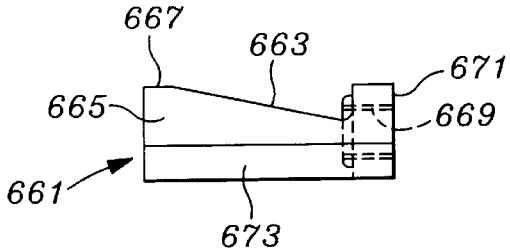
FIG. 64 is a side view and more clearly illustrating the pair of inclined front surface side walls for engaging an inclined lower surface of the main bolt, and the angular relation ship of the inclined front surface of the side walls to the small flat front surface, the linearity of the angled back side of the side walls, as well as the transition to a the foot shaped base and showing the threaded through bore in the base in dashed line format.

FIG. 62 is a frontal view of a open top wedge 661 utilizable in conjunction with the wedge stabilization block 651 of FIGS. 59–61 and illustrating a pair of inclined front surfaces 663 on side walls 665 for engaging inclined lower surface 483 of the main bolt 479, and each of which leads to a small flat front surface 667, FIG. 62 also illustrating a rearward angled surface definition on the side walls and which are shown in dashed line format as is a threaded through bore 669 in a base 671 supporting the side walls 665. FIG. 63 is a top end view of the wedge 661 of FIG. 62 and directly illustrating the through bore 669 of the base, as well as the depth of the side walls 665 and particularly illustrating the angled nature of the rear surfaces 673 of the side walls 665 and when compared to FIG. 60, how the angled rear surfaces 673 of the side walls which interfit with the wedge stabilization block 661 of FIG. 60. FIG. 64 is a side view and more clearly illustrating the pair of inclined front surface side walls 663 for engaging an inclined lower surface 483 of the main bolt 479, and the angular relation ship of the inclined front surface 663 of the side walls 665 to the small flat front surface 667, the linearity of the angled back side 673 of the side walls 665, as well as the transition to the foot shaped base 671 and showing the threaded through bore 669 in the base in dashed line format.

Figure 65:
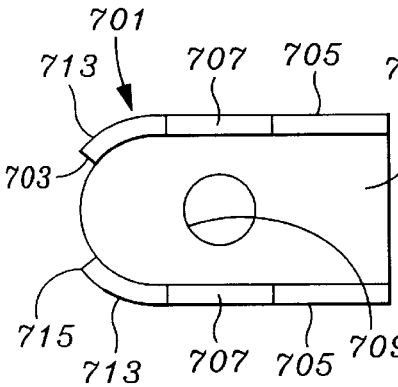
FIG. 65 is a frontal view of a fourth embodiment of a wedge stabilization block with a partially enclosed top end and illustrating the front of its side walls, notches in the front of its side walls and an aperture for accommodating the main bolt of FIGS. 51 and 52.
Figure 66:
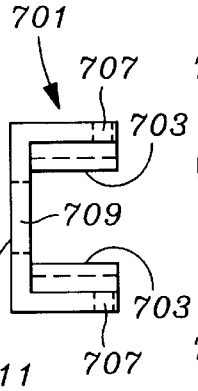
FIG. 66 is a bottom end view of the wedge stabilization block of FIG. 59 and illustrating the extent of curvature at the far top end, as well as a dashed line formal illustrating further the cut of the top end, the edge of the top sides, and the side wall notches and aperture for accommodating main bolt shown in dashed line format.
Figure 67:
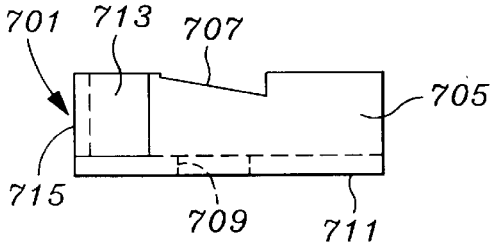
FIG. 67 is a side view of the wedge stabilization block of FIGS. 65 and 66 with the aperture for accommodating the main bolt shown in dashed line format, and the top partially closed side walls shown in phantom.

FIG. 65 is a frontal view of a fourth embodiment of a wedge stabilization block 701 with a partially enclosed top end 703 and illustrating the front of its side walls 705, notches 707 in the front of its side walls 705 and an aperture 709 in a back wall 711 for accommodating the main bolt 479 of FIGS. 51 and 52. The upper curved ends 713 of the walls 705 have outer edges 715. FIG. 66 is a bottom end view of the wedge stabilization block 701 of FIG. 59 and illustrating the extent of curvature of the curved ends 713 of the walls 705 at the far top end, as well as a dashed line format illustrating outer edges 715, and the side wall notches 707 and aperture 709 for accommodating main bolt 479 shown in dashed line format. FIG. 67 is a side view of the wedge stabilization block 701 of FIGS. 65 and 66 with the aperture 709 shown in dashed line format, and the top curved ends 713 of the side walls 705 shown in phantom.

Figure 68:
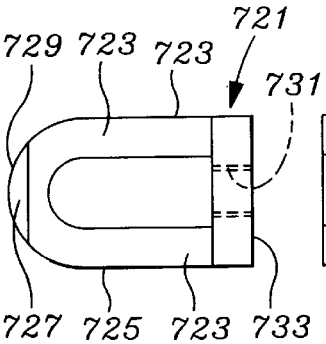
FIG. 68 is a frontal view of a flattened top wedge utilizable in conjunction with the wedge stabilization block of FIGS. 65–67 and illustrating a pair of inclined front surface side walls for engaging an inclined lower surface of the main bolt, and each of which leads to a more abbreviated flat front surface due to a flattening of the top portion, and shown in dashed line format as is a threaded through bore in a base supporting the side walls.
Figure 69:
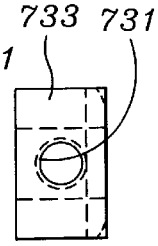
FIG. 69 is a bottom end view of the wedge of FIG. 62 and directly illustrating the through bore of the base.
Figure 70:
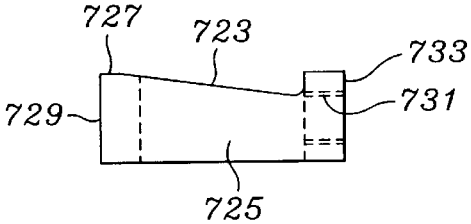
FIG. 70 is a side view and more clearly illustrating the pair of inclined front surface side walls for engaging an inclined lower surface of the main bolt, and the angular relation ship of the inclined front surface of the side walls to the small flat front surface, and the shortened length due to the top flat surface.

FIG. 68 is a frontal view of a top wedge 721 utilizable in conjunction with the wedge stabilization block 701 of FIGS. 65–67 and illustrating a pair of inclined front surfaces 723 on a pair of side walls 725 for engaging an inclined lower surface 483 of the main bolt 479, and each of which leads to a more abbreviated flat front surface 727 which is immediately adjacent a curved top 729, and shown in dashed line format as is a threaded through bore 731 in a base 733 supporting the side walls 725. FIG. 69 is a bottom end view of the wedge 721 of FIG. 62 and directly illustrating the through bore 731 of the base. FIG. 70 is a side view and more clearly illustrating the pair of inclined front surfaces 723 of the side walls 725 for engaging an inclined lower surface 483 of the main bolt 479, and the angular relation ship of the inclined front surface of the side walls 725 to the small flat front surface 727, and the shortened length due to the curved top surface 729.

While the present invention has been described in terms of a bearing system which can be utilized in both vertical blind and roller shade configurations, a double bearing set system for use with roller shades as well as vertical blinds, one skilled in the art will realize that the structure and techniques of the present invention can be applied to many similar appliances. The present invention may be applied in any situation where controlled bearing support is desired, as well as bearing support having the capability to make up for differences in tolerance of component parts, and where bearing forces are to be split evenly about a bearing supported sprocket, and where the holding force on a roller shade assembly is to be more stable, more secure, and more evenly balanced.

Although the invention has been derived with reference to particular illustrative embodiments thereof, many changes and modifications of the invention may become apparent to those skilled in the art without departing from the spirit and scope of the invention. Therefore, included within the patent warranted hereon are all such changes and modifications as may reasonably and properly be included within the scope of this contribution to the art.

What is claimed:

1. A roller shade support system comprising:

a housing for support and having a centrally located first conical bearing surface, and a first bore through said housing at the center of said conical bearing surface;

a sprocket portion for engaging one of a rope and chain and having a second generally conical bearing surface adjacent and complementary to said centrally located first conical bearing surface of said bracket, and having a cylindrical insertion member extending therefrom opposite said second conical bearing surface, and a third generally conical bearing surface located within said cylindrical insertion member and a second bore at the center of said second and said third conical bearing surfaces and through said sprocket portion;

a conical bearing structure having a fourth generally conical surface adjacent and complementary to said third generally conical surface, and having a third bore at the center of said fourth conical bearing surfaces and through said conical bearing structure;

adjustable axial force connection means for urging said conical bearing structure toward said housing and through said first, said second and said third bores, to control the frictional bearing contact between of said sprocket portion and both said conical bearings structure and said housing; and a bracket having a main planar expanse and including an aperture for engagement of said adjustable axial force connection means and adjacent at least a portion of said first bore, and at least one key projection.

2. The system as recited in claim 1 wherein said housing has three slots for engagement with said key projection, each of said slots located to engage said key projection placing said housing in a position at least a 90° rotational displacement from a position attainable from engagement of said key projection in the other ones of said slots.

3. The system as recited in claim 2 and wherein said housing has an elongate slot and wherein said bracket has three key projections each having a threaded aperture for facilitating operation of a wedge within said elongate slot.

4. The system as recited in claim 3 and further comprising a wedge member translatable within said elongate slot and engaging said adjustable axial force connection means to increase and decrease tension on said adjustable axial force connection means.

5. The system as recited in claim 4 and wherein said wedge further comprises a pair of side walls having inclined front surfaces and a base having a threaded aperture and connected to said pair of side walls.

6. The system as recited in claim 5 and wherein said side walls have first ends connected to said base having a threaded aperture, and are joined at their second ends.

7. The system as recited in claim 1 wherein said at least one key projection engages a key slot located in said housing and where said housing is supported by said bracket and prevented from rotation with respect to said bracket by insertion of said key projection into said at least one key slot.

8. The system as recited in claim 7 wherein said housing has three key slots for engagement with said key projection, each of said key slots located to engage said key projection placing said housing in a position at least a 90° rotational displacement from a position attainable from engagement of said at least one key projection in the other ones of said key slots.

9. The system as recited in claim 8 and wherein said housing has an elongate slot and wherein said bracket has three key projections each having a threaded aperture for facilitating operation of a wedge within said elongate slot.

10. The system as recited in claim 9 and further comprising a wedge member translatable within said elongate slot and engaging said adjustable axial force connection means.

11. A roller shade support system comprising:

a housing for support and having a centrally located first conical bearing surface, and a first bore through said housing at the center of said conical bearing surface;

a sprocket portion for engaging one of a rope and chain and having a second generally conical bearing surface adjacent and complementary to said centrally located first conical bearing surface of said bracket, and having a cylindrical insertion member extending therefrom opposite said second conical bearing surface, and a third generally conical bearing surface located within said cylindrical insertion member and a second bore at the center of said second and said third conical bearing surfaces and through said sprocket portion;

a conical bearing structure having a fourth generally conical surface adjacent and complementary to said third generally conical surface, and having a third bore at the center of said fourth conical bearing surfaces and through said conical bearing structure;

adjustable axial force connection means for urging said conical bearing structure toward said housing and through said first, said second and said third bores, to control the frictional bearing contact between of said sprocket portion and both said conical bearings structure and said housing, and wherein said adjustable axial force connection means further comprises:

a primary adjustment means for providing a first magnitude range of urging force of said conical bearing structure toward said housing; and a secondary adjustment means for providing a second magnitude range of urging force of said conical bearing structure toward said housing and less than said first magnitude range of urging force.

12. The system as recited in claim 11 wherein said primary adjustment means is a bolt having a first end having a head and a head underside surface; and a nut connected to said second end of said bolt.

13. The system as recited in claim 12 wherein said secondary adjustment means is a translatable wedge engaging said head underside surface of said bolt.

14. A roller shade support system comprising:

a housing for support and having a first bearing structure, and a first bore through said housing at the center of said first bearing structure;

a sprocket portion for engaging one of a rope and chain and having a second bearing structure adjacent and complementary to said first bearing structure of said housing, and having a cylindrical insertion member extending therefrom opposite said second bearing structure, and a third bearing structure located within said cylindrical insertion member and a second bore at the center of said second and said third bearing structures and through said sprocket portion;

a bearing component having a fourth bearing structure adjacent and complementary to said third bearing structure, and having a third bore at the center of said fourth bearing structure and through said bearing component; and adjustable axial force connection means for urging said bearing component toward said housing and through said first, said second and said third bores, to control the frictional bearing contact between said sprocket portion and both said bearing component and said housing.

15. The system as recited in claim 14 wherein at least one of said first, second, third, and fourth bearing structures includes slots and further comprising a roller bearing carried within each said slot.

16. The system as recited in claim 15 wherein said first, second, third, and fourth bearing structures are conically shaped.

17. The system as recited in claim 14 and further comprising a bracket having a main planar expanse and including a key projection extending from said main planar expanse and engaging a key slot located in said housing and where said housing is supported by said bracket and prevented from rotation with respect to said bracket by insertion of said key projection into said slot.

18. The system as recited in claim 17 wherein said housing has three slots for engagement with said key projection, each of said slots located to engage said key projection placing said housing in a position at least a 90° rotational displacement from a position attainable from engagement of said key projection in the other ones of said slots.

19. The system as recited in claim 18 and wherein said housing has an elongate slot and wherein said bracket has three key projections each having a threaded aperture for facilitating operation of a wedge within said elongate slot.

20. The system as recited in claim 14 and further comprising a bracket having a main planar expanse and including an aperture for engagement with said adjustable axial force connection means.

* * * * *